US006924425B2

(12) United States Patent
Naples et al.

(10) Patent No.: US 6,924,425 B2
(45) Date of Patent: Aug. 2, 2005

(54) METHOD AND APPARATUS FOR STORING A MULTIPART AUDIO PERFORMANCE WITH INTERACTIVE PLAYBACK

(75) Inventors: Bradley J. Naples, Hanover, NH (US); Kevin D. Morgan, Nashua, NH (US)

(73) Assignee: Namco Holding Corporation, San Diego, CA (US)

( * ) Notice: Subject to any disclaimer, the term of this patent is extended or adjusted under 35 U.S.C. 154(b) by 0 days.

(21) Appl. No.: 10/118,862

(22) Filed: Apr. 9, 2002

(65) Prior Publication Data

US 2002/0162445 A1 Nov. 7, 2002

Related U.S. Application Data

(63) Continuation-in-part of application No. 09/900,289, filed on Jul. 6, 2001, now abandoned, and a continuation-in-part of application No. 09/900,287, filed on Jul. 6, 2001, now abandoned.

(60) Provisional application No. 60/282,420, filed on Apr. 9, 2001, provisional application No. 60/282,549, filed on Apr. 9, 2001, provisional application No. 60/288,876, filed on May 4, 2001, and provisional application No. 60/288,730, filed on May 4, 2001.

(51) Int. Cl.[7] ..... G10H 1/18

(52) U.S. Cl. ..... 84/609; 84/610; 84/622; 84/634; 84/649; 84/650; 84/659; 84/666

(58) Field of Search ..... 84/600–609, 645, 84/610, 622–625, 634, 649–650, 659–660, 666

(56) References Cited

U.S. PATENT DOCUMENTS 5,159,143 A * 10/1992 Emi et al. ..... 84/645
5,321,200 A * 6/1994 Yamamoto ..... 434/307 A
5,393,926 A * 2/1995 Johnson ..... 84/610
5,670,729 A * 9/1997 Miller et al. ..... 84/609
5,734,119 A 3/1998 France et al.
5,792,971 A * 8/1998 Timis et al. ..... 84/609
5,805,545 A * 9/1998 Nakamaru et al. ..... 369/47.23
5,883,326 A 3/1999 Goodman et al.
5,908,997 A 6/1999 Arnold et al. ..... 84/615
5,952,599 A 9/1999 Dolby et al. ..... 84/649
6,018,118 A 1/2000 Smith et al. ..... 84/600
6,093,880 A 7/2000 Arnalds ..... 84/464
6,175,070 B1 * 1/2001 Naples et al. ..... 84/609
6,388,181 B2 * 5/2002 Moe ..... 84/477 R
6,822,153 B2 * 11/2004 Comair et al. ..... 84/609
2001/0035087 A1 * 11/2001 Subotnick ..... 84/600

* cited by examiner

*Primary Examiner*—Marlon T. Fletcher
*Assistant Examiner*—David S. Warren
(74) *Attorney, Agent, or Firm*—Wilmer Cutler Pickering Hale and Dorr LLP

(57) ABSTRACT

A computer-readable medium stores a data structure that encodes an audio performance for interactive playback. The data structure includes a virtual instrument pool, which encodes an interactive part of the audio performance. Audio content of the interactive part is encoded at least in a sequence of synthesizer control data. Each datum in the synthesizer control data specifies a digital sample of the audio content to be played back. The data structure also includes a global accompaniment pool, which encodes non-interactive portions of the audio performance. The global accompaniment pool includes timing information to synchronize the playback of the audio performance.

21 Claims, 17 Drawing Sheets

METHOD AND APPARATUS FOR STORING A MULTIPART AUDIO PERFORMANCE WITH INTERACTIVE PLAYBACK

RELATED APPLICATIONS

This application is a continuation-in-part of and claims the priority of: U.S. patent application Ser. No. 09/900,289, entitled "A Multimedia Data File" and filed on Jul. 6, 2001, now abandoned, and is a continuation in U.S. patent application Ser. No. 09/900,287, entitled "A Virtual Music System", filed on Jul. 6, 2001, now abandone, and claims benefit of U.S. Provisional Application Ser. No. 60/282,420, entitled "A Multimedia Data File", and filed Apr. 9, 2001; U.S. Provisional Application Ser. No. 60/282,549, entitled "A Virtual Music System", and filed Apr. 9, 2001; U.S. Provisional Application Ser. No. 60/288,876, entitled "A Multimedia Data File", and filed May 4, 2001; and U.S. Provisional Application Ser. No. 60/288,730, entitled "An Interactive Karaoke System", and filed May 4, 2001.

This application herein incorporates by reference: U.S. Pat. No. 5,393,926, entitled "Virtual Music System", filed Jun. 7, 1993, and issued Feb. 28, 1995; U.S. Pat. No. 5,670,729, entitled "A Virtual Music Instrument with a Novel Input Device", filed May 11, 1995, and issued Sep. 23, 1997; and U.S. Pat. No. 6,175,070 B1, entitled "System and Method for Variable Music Annotation", filed Feb. 17, 2000, and issued Jan. 16, 2001.

TECHNICAL FIELD

This invention relates to multipart data files.

BACKGROUND

Moving Picture Experts Group (MPEG or MP3) and Musical Instrument Digital Interface (MIDI) are protocols for digital audio storage and transmission.

MIDI was designed for the recording and playback of digital audio content on synthesizers. MIDI streams do not represent audio content directly but provide information about how the content is to be synthesized. MIDI streams are multi-track, where each track can be mapped to a discrete profile such as a musical instrument. Each track of the MIDI stream includes the discrete notes to be played by that instrument. Since a MIDI file is the computer equivalent of traditional sheet music for a particular song (figuratively speaking, as opposed to the sound recording for the song itself, these files tend to be small and compact when compared to files which record the audio content directly and continuously. However, MIDI streams typically require some form of wave table or FM synthesizer chip to generate their sounds. Additionally, MIDI files tend to lack the richness and robustness of actual sound recordings of the same content.

MP3 streams, unlike MIDI streams, contain actual sound recordings of audio content. Typically, MP3 streams are single track files and do not include information concerning the specific musical notes or the instruments utilized in the recording. However, while MIDI files typically require additional hardware in order to be played back, MP3 files can quite often be played back on a modem multimedia personal computer with a minimal amount of specialized hardware.

SUMMARY

In general, in one aspect, the invention features a computer-readable medium having a data structure encoding an audio performance for interactive playback stored thereon. The data structure includes a virtual instrument pool that encodes an interactive part of the audio performance. Audio content of the interactive part is encoded at least in a sequence of synthesizer control data. Each datum in the synthesizer control data specifies a digital sample of the audio content to be played back. The data structure also includes a global accompaniment pool, which encodes non-interactive portions of the audio performance. The global accompaniment pool includes timing information to synchronize the playback of the audio performance.

Preferred embodiments include one or more of the following features. The synthesizer control data is MIDI data. The digital sample is an MP3 clip. The global accompaniment pool encodes a non-interactive part of the audio content of the audio performance. The global accompaniment pool includes a collection of sound fonts, in which each sound font provides parameters for synthesizing the playback of an interactive part.

In general, in another aspect, the invention features a computer-readable medium that stores a data structure which encodes an audio performance for interactive playback. The data structure includes a global accompaniment pool, which encodes a non-interactive part of the audio performance. A portion of the non-interactive part is encoded as synthesizer control data, while another portion of the non-interactive part is encoded as digital samples of the audio performance. The data structure also includes a virtual instrument pool, which encodes an interactive part of the audio performance. The interactive part has audio content encoded at least in synthesizer control data. Each datum in the synthesizer control data specifies musical notes to be synthesized, or specifies a digital sample of the audio content to be played back.

Preferred embodiments include one or more of the following features. The synthesizer control data is MIDI data. The digital samples are MP3 clips. The virtual instrument pool includes cue data that specifies prompts coordinated with the audio content the interactive part.

In general, in still another aspect, the invention features code stored on a computer readable medium. The code is a computer in an entertainment system that includes an audio output subsystem, an input device, and a memory storing a musical performance data structure having an interactive portion of a musical performance and an accompanying, non-interactive portion of the musical performance. The code includes a virtual manager object which causes the computer to read the musical performance data structure stored in the memory and generate a virtual object representing a virtual instrument identified in the performance data structure. The virtual object causes the computer to map user input from the input device to the interactive portion of the musical performance and play the mapped interactive portion of the musical performance through the audio output subsystem. The code also includes a global accompaniment object which causes the computer to play the accompanying non-interactive portion of the musical performance through the audio output system.

Preferred embodiments include one or more of the following features. The stored musical performance data structure identifies a plurality of different virtual instruments, each representing a different musical instrument. The virtual manager object causes the computer to generate a plurality of virtual objects, each of which represents a different corresponding one of the identified plurality of instruments. Each of the virtual objects causes the computer to map user input from input devices to a corresponding part of the interactive portion of the musical performance and play the mapped corresponding part of the interactive portion of the musical performance through the audio output subsystem.

The global accompaniment object also includes logic which when executed on the computer causes it to provide a master timing signal for the virtual object.

Assuming that the entertainment system includes a video display subsystem and the stored musical performance data structure includes a stored sequence of timing cues associated with the interactive portion of the musical performance, the virtual object also includes logic which causes the computer to display a visual representation of the timing cues through the video display system to aid the user in playing the virtual instrument. Also assuming that the stored musical performance data structure includes a plurality of digital clips each representing a different part of the non-interactive portion of the musical performance and a sequence of trigger points, each of which presents timing information and identifies which one of the digital clips is to be played at times identified in the timing information, then in that case the global accompaniment object includes logic which causes the entertainment system to play through the audio output subsystem the identified one of the plurality of digital clips at the appropriate time as identified by the stored sequence of trigger points.

Assuming that the audio output subsystem includes a synthesizer and the stored musical performance data structure includes sound fonts, the accompaniment object further includes logic that causes the computer to retrieve the sound fonts from the stored musical performance data structure and load them into the synthesizer to control the character of the audio output subsystem.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
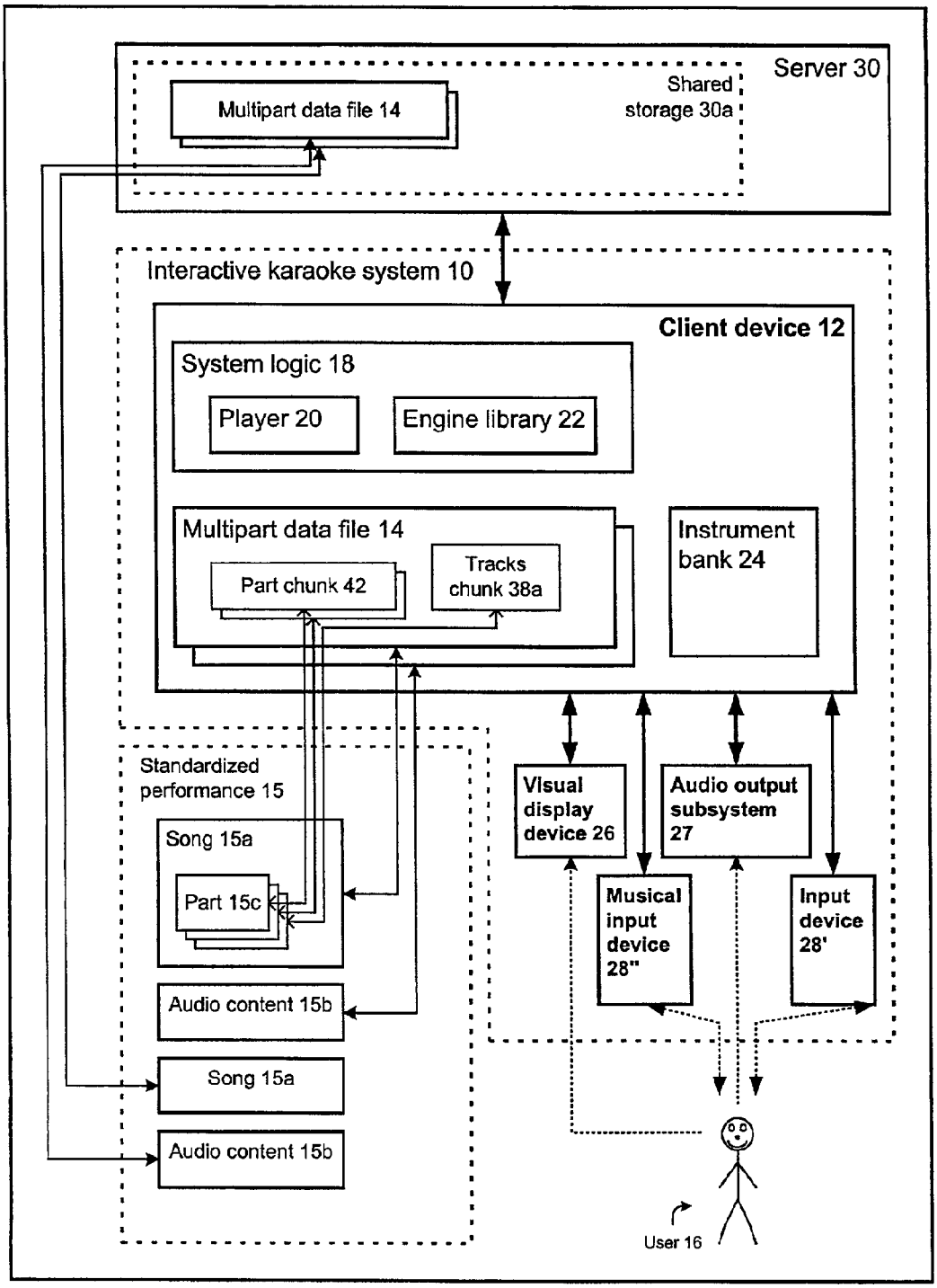
FIG. 1A is a block diagram of an interactive karaoke system.

In one embodiment, a data file contains a standardized performance of music or sound digitally encoded, typically at a high quality—for instance, comparable to FM radio or better. Methods for digitally encoding the sound include digital recordings or samples in a format such as MP3, as well as synthesizer parameters in a format such as MIDI. The standardized performance is encoded in one or more parts that can be played back synchronously by an interactive karaoke system. For instance, the standardized performance can be a song or musical performance, with various parts allocated to musicians and their vocals or instruments.

The data file contains additional content such as timing cues, lyrics, and other features, as will be explained. The additional content is time-correlated to the audio content for synchronous playback.

One or more human users can use the interactive karaoke system. Each user has an input device and a part to "play", i.e., to interact with in real time via the input device. The interactive karaoke system presents a user interface via a display device to the users. The interactive karaoke system manages synchronous playback of the audio content. During playback, the karaoke system visually prompts each user to interact with the karaoke system according to timing information encoded in the part. The interactive karaoke system correlates user inputs at the input device to the user's part. The interactive karaoke system then plays audio content from the part to simulate the user playing the part. When the audio content represents a musical performance, for instance, the interactive karaoke system can recreate a version of that musical performance as apparently played by the one or more users.

To play a part, the user chooses the part and an input device. The system automatically selects the sound profiles (or "sound fonts", as will be explained) for that part. A virtual instrument uses a part, an input device, and a sound font. Virtual instruments are encoded as software objects generated and maintained by the karaoke system.

In general, this description distinguishes live performances from the standardized performance encoded in the data file. A live performance is the karaoke system's rendering of the standardized performance after adjusting for real-time user inputs and for user preferences. The live performance usually deviates from the standardized performance as a result of these adjustments. For example, if a user's inputs stray too far from the timing information encoded in part, then the karaoke system will suppress all or part of the audio output for that part. Other deviations can be due to timing. The karaoke system plays samples from the standardized performance according to the timing of the real-time user input. If the user deviates too far from the timing of the standardized performance, therefore, the live performance will deviate as well. Still other deviations can be due to system settings that the user chooses. For instance, a user can choose to have the karaoke system omit one or more parts of the standardized performance. The variations between live performances and the standardized performance contribute to the entertainment value of the karaoke system.

Interactive aspects of the system and the content of the multipart file are suitable for musical instruction, as well. Still another use of the multipart file applies to deejay software.

SYSTEM

Referring now to FIG. 1A, an interactive karaoke system 10 plays multipart data files 14, each of which corresponds to a standardized performance 15 such as a song 15*a* or audio content 15*b*. Each standardized performance 15 contains one or more parts 15*c*, which typically are audio content of standardized performance 15 assigned to a particular instrument or human performer. Data file 14 includes either a part chunk 42 or a tracks chunk 38*a* for each part 15*c* of standardized performance 15, as will be explained. Multipart data file 14 contains sufficient information for system 10 to reproduce standardized performance 15 and parts 15*c*.

Karaoke system 10 includes interactive and audio-visual features. For instance, a user 16 interacts with system 10 via an input device 28, which can be a musical input device 28". User 16 views a visual display device 26, through which system 10 displays information to user 16. Audio output subsystem 27 produces sound audible to user 16, including the live performance.

System logic 18 includes procedures encoded as instructions that can be carried out by a processing device, as will be explained. In other words, system logic 18 is software. System logic 18 includes a player application 20 and an engine library 22, explained later.

PART ENCODING PROCESS

In general, system 10 distinguishes between "interactive" or "non-interactive" parts 15*c* of a standardized performance 15. System 10 makes interactive parts 15*c* available to be played by user 16 during a live performance. System can render interactive parts 15*c* either automatically (in a demonstration or guide mode) or interactively (subject to user input stimuli, as will be explained.) In contrast, system 10 renders non-interactive parts 15*c* automatically during a live performance. Non-interactive parts 15*c* are background or accompaniment to interactive parts 15*c*.

The distinction between interactive and non-interactive parts 15*c* is encoded in data file 14. In general, interactive parts 15*c* correspond to part chunks 42 in VI pool 40 (shown in FIG. 2), while non-interactive parts 15*c* correspond to tracks chunk 38*a* in accompaniment pool 38.

Figure 1B:
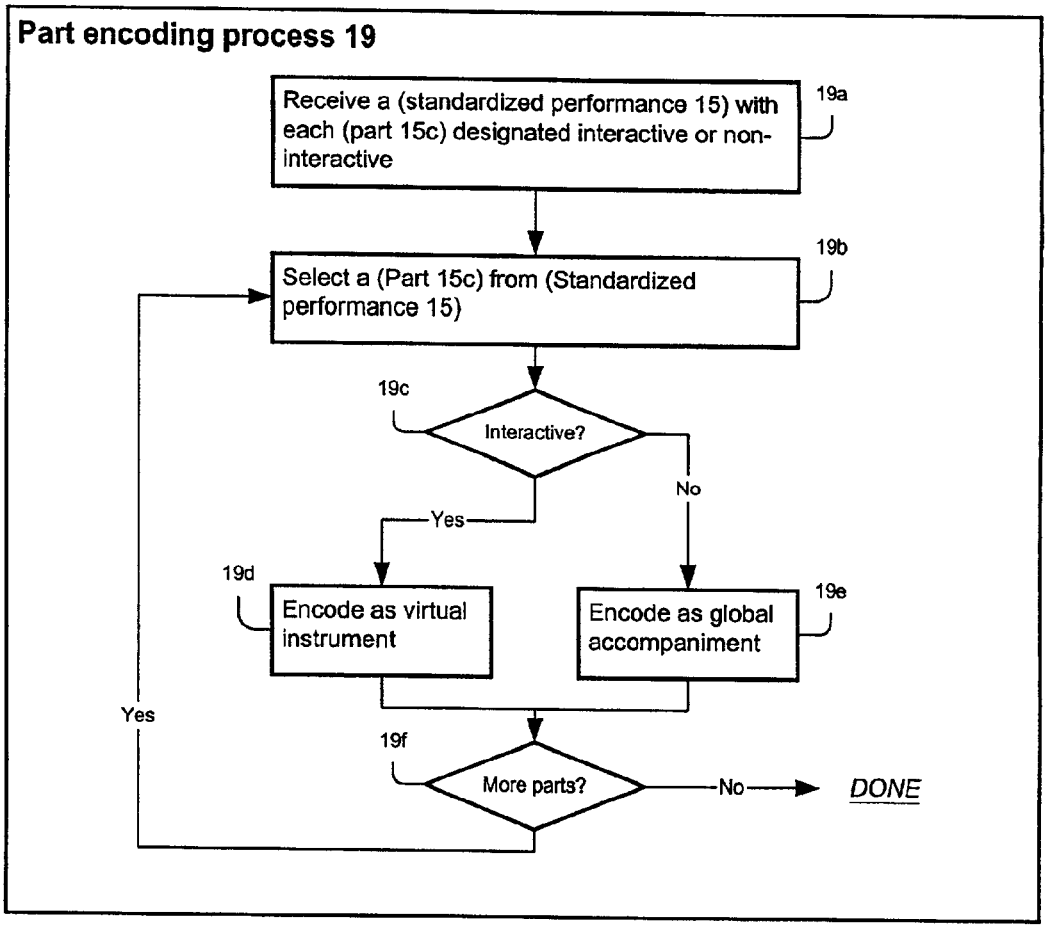
FIG. 1B is a flowchart of a part encoding process.

Referring now to FIG. 1B, a part encoding process 19 maps parts 15*c* to portions of a data file 14, broadly speaking. Part encoding process 19 receives a standardized performance 15 with each part 15*c* designated interactive or non-interactive (process 19*a*). For example, a human administrator could provide such designations.

Part encoding process 19 selects a part 15*c* from a standardized performance 15 to be encoded in a data file 14 (process 19*b*). Part encoding process 19 tests whether part 15*c* is interactive (process 19*c*). If the test is affirmative, part encoding process 19 encodes part 15*c* as a virtual instrument (process 19*d*). For instance, the part 15*c* is mapped to a part chunk: 42 in VI pool 40 in data file 14. If the test is not affirmative, part encoding process 19 encodes part 15*c* as a portion of the global accompaniment (process 19*e*). For instance, the part 15*c* is mapped to a tracks chunk 38*a* in accompaniment pool 38 in data file 14.

Part encoding process 19 returns to process 19*b* for each part 15*c* in the input (process 19*f*).

FILE STRUCTURE

Figure 2:
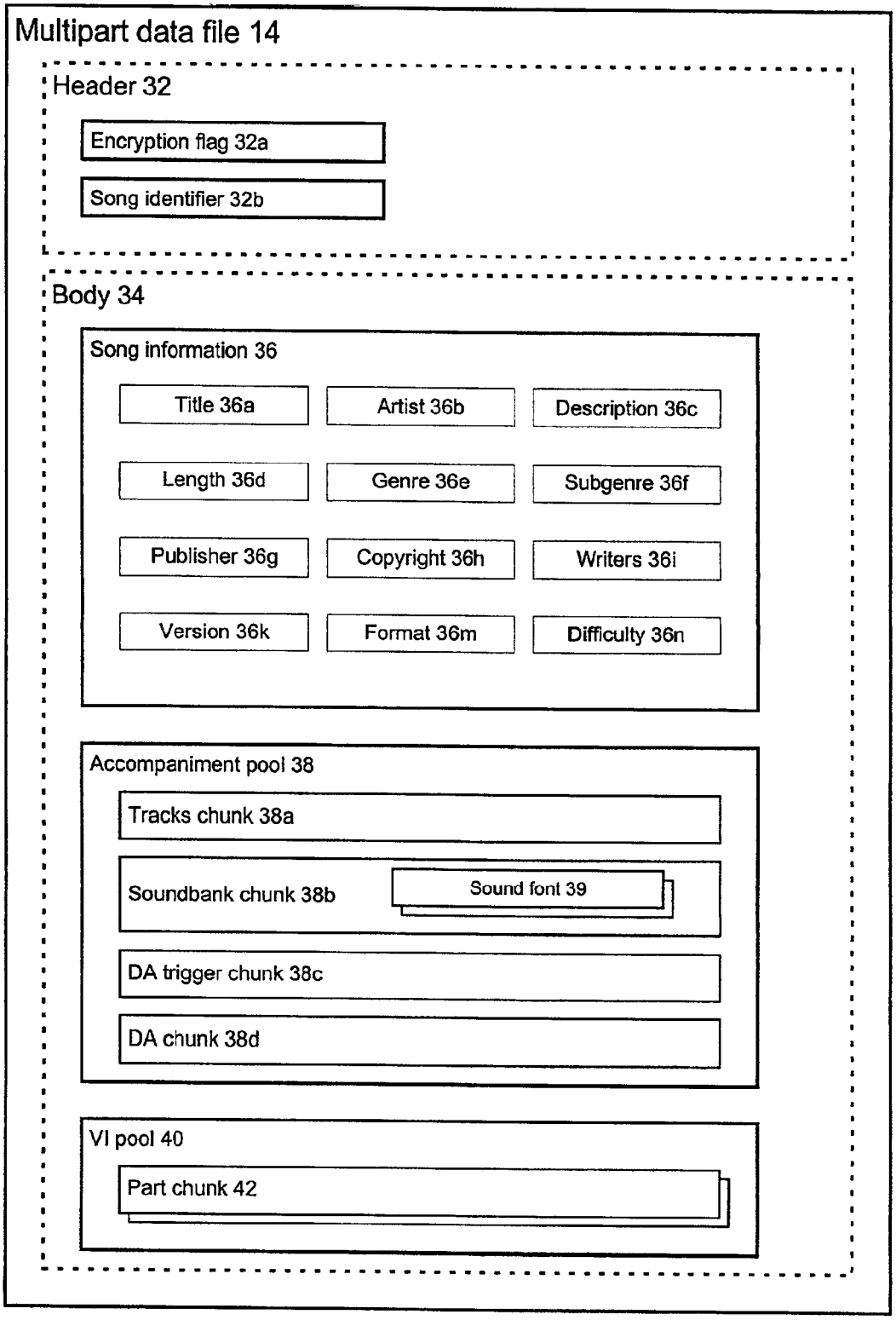
FIG. 2 is a block diagram of a multipart data file.

Referring now to FIG. 2, a multipart data file 14 includes a header 32 and a body 34. The header 32 typically precedes the body 34 in file 14. The header 32 contains an encryption flag 32*a* that indicates whether body 34 is encrypted, and a song identifier 32*b*. Song identifier 32*b* is a value that uniquely identifies song 15*a* relative to other songs 15*a*. For example, song identifier 32*b* can act as a product number in a publisher's catalog of songs 15*a*.

Body 34 includes song information 36, an accompaniment pool 38, and a virtual instrument (or "VI") pool 40. Song information 36 specifies the standardized performance 15 associated with multipart data file 14. Song information 36 includes fields such as title 36*a*, artist 36*b*, description 36*c*, length 36*d*, genre 36*e*, subgenre 36*f*, publisher 36*g*, copyright 36*h*, writers 36*i*, version 36*k*, format 36*m*, and difficulty rating 36*n*. Title 36*a* is a name that identifies the standardized performance 15 to user 16. Description 36*c*, genre 36*e*, and subgenre 36*f* further explain the standard performance 15 to user 16. Artist 36*b* indicates one or more artists represented in the standardized performance 15. Length 36*d* indicates the duration in time of the standardized performance 15. Publisher 36*g*, copyright 36*h*, and writers 36*i* identify intellectual property rights in the standardized performance 15, while version 36*k* and format 36*m* are metadata that assist different versions of system 10 (for instance, future revisions) in recognizing the rubrics in place at the time that that data file 14 was encoded. Difficulty rating 36*n* is a measure of the overall difficulty of the parts 15*c* in the standardized performance 15.

Accompaniment pool 38 and VI pool 40 include data formatted as chunks 50. Moreover, accompaniment pool 38 and VI pool 40 themselves use the chunk 50 format. Chunks 50 are described with reference to FIG. 3A.

ACCOMPANIMENT POOL

In general, accompaniment pool 38 contains information that interactive karaoke system 10 interprets in order to manage a live performance and to render non-interactive parts 15*c*. Furthermore, accompaniment pool 38 provides sound fonts 39 specific to the standardized performance 15, as will be explained. Accompaniment pool 38 contains a tracks chunk 38*a*, a soundbank chunk 38*b*, a DA (for "digital audio") trigger chunk 38*c*, and a DA chunk 38*d*.

The tracks chunk 38*a* encodes global accompaniment content. The tracks chunk 38*a* includes timing to define the tempo and length at which system 10 will render the corresponding standardized performance 15. The tracks chunk 38*a* usually (but not always) also encodes actual audio content. For instance, the tracks chunk 38*a* could be part of a standardized performance 15 that contains an unaccompanied part 15*c*, for instance a solo vocal performance. In this case, the standardized performance 15 is still encoded with a global accompaniment track 38*a*, at least to provide a master timing signal.

SOUNDBANK AND SOUND FONTS

The soundbank chunk 38*b* provides sound fonts 39 specific to the standardized performance 15 corresponding to file 14.

A sound font 39 includes samples and acoustical characteristics for a virtual instrument. Acoustical characteristics include the envelope, or volume of a sample as it moves over time. The envelope typically includes an attack (initial volume rising rapidly over time), an initial decay from attack, sustain (held for as long as note needs to be held), and release (what happens to the sound when the instrument is done playing the note).

For example, if the sound font 39 is for an overdriven guitar, the sample will be an actual recording of an overdriven guitar playing a defined note or frequency. If user 16 provides an input stimulus that, according to performance track 48*a* (shown in FIG. 3B), corresponds to a note having the same frequency as the sample, the sample will be played without modification. However, if that input stimulus corresponds to a note at a different frequency than the frequency of the sample, interactive karaoke system 10 will shift the frequency of the sample to that of the required note. Synthesizer 66*a* (shown in FIG. 5) can perform frequency shifts.

In the described embodiment, sound fonts 39 are compatible with technologies and products from Creative Labs, Inc.

DA TRIGGER AND DA CHUNK

DA trigger chunk 38*c* gives a set of control messages that allow playing digital audio clips such as MP3 samples. The clips themselves are stored in DA chunk 38*d*.

DA trigger chunk 38*c* indexes the clips and includes information that maps MIDI note event values to MP3 samples, for example in a table of pairs that associate note event values with clips. The DA guide track 48*g* associated with a part 15*c* can use these indexes as a space-efficient shorthand when referencing the clips.

VI POOL

VI pool 40 includes a collection of part chunks 42. Multipart data file 14 includes a part chunk 42 for each virtual instrument playable in the corresponding standardized performance 15. Part chunk 42 formats are explained with reference to FIG. 3B. Broadly, a part chunk 42 holds the data that encodes an interactive part 15*c*. As will be explained, the VI Manager looks for the VI pool 40 during startup and generates a virtual instrument object 80 for each part chunk 42.

CHUNKS

Figure 3A:
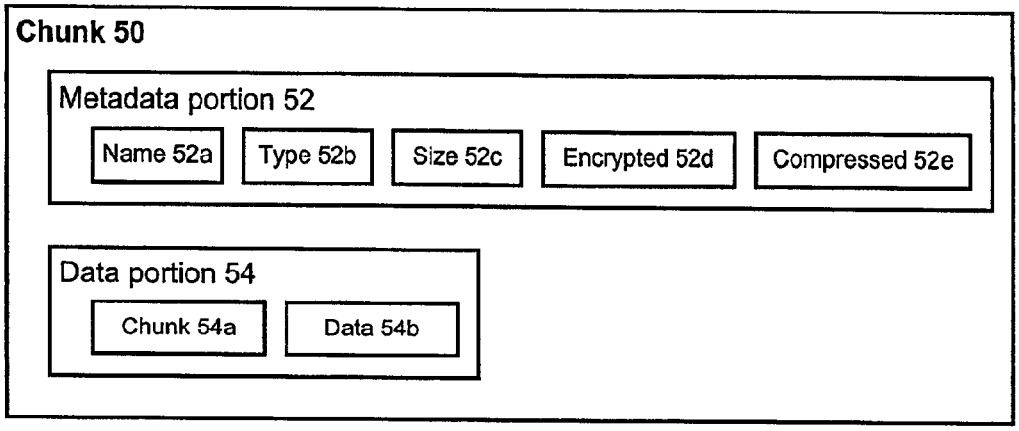
FIG. 3A is a block diagram of a chunk.

Referring now to FIG. 3A, a chunk 50 is a format for storage of digital information. The chunk 50 format can store a wide range of data. Chunk 50 includes a metadata portion 52 and a data portion 54. Metadata fields describe the nature of data stored in the data portion 54. Metadata 52 includes name 52*a*, type 52*b*, size 52*c*, an encryption indicator 52*d*, and a compression indicator 52*e*. Encryption indicator 52*d* indicates whether data portion 54 is encrypted. Compression indicator 52*e* describes a compression scheme used in data portion 54. Typically, metadata 52 is stored as plaintext, while data portion 54 is stored with encryption and compression.

Examples of data stored in data portion 54 include digital audio recordings, MIDI data, and text. Data portion can also store additional chunks 50—that is, the structure of chunk 50 is recursive. Size 52*c* indicates when a given chunk 50 ends.

PART CHUNKS

Figure 3B:
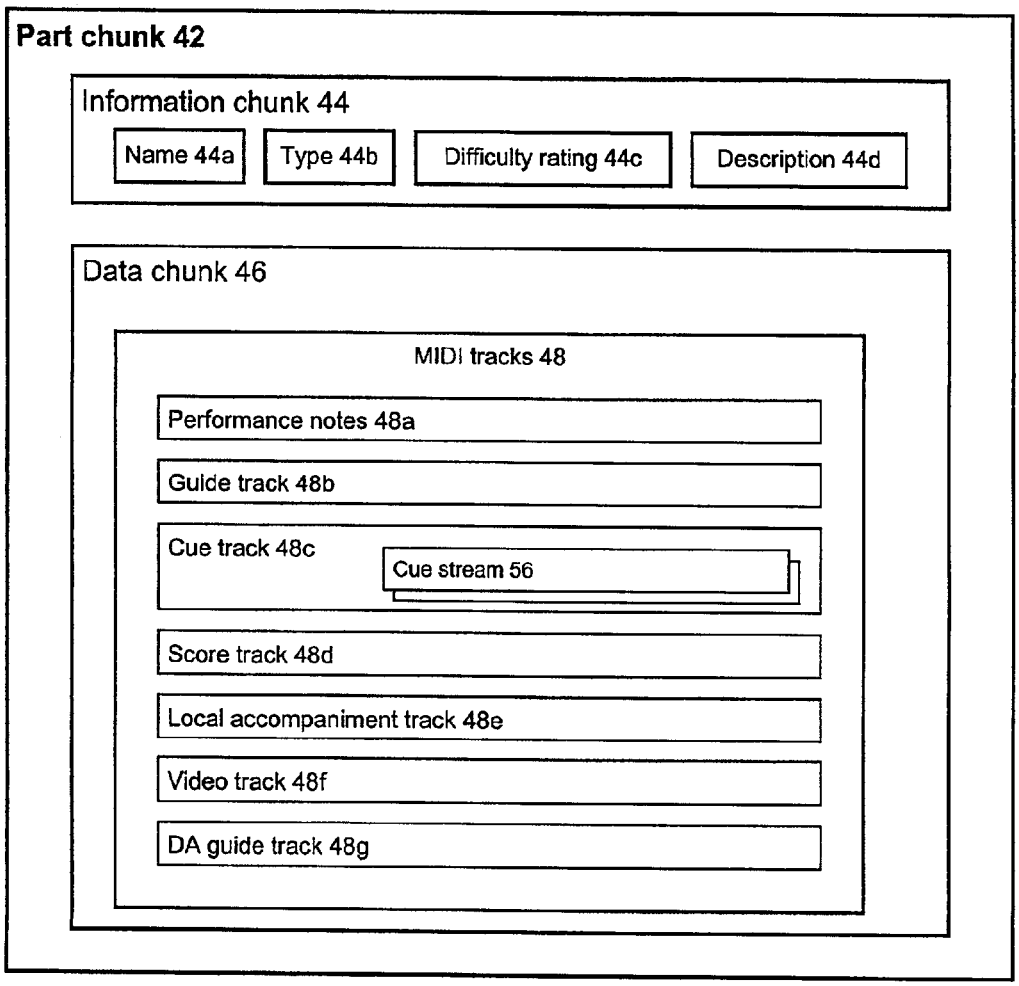
FIG. 3B is a block diagram of a part chunk.

Referring now to FIG. 3B, a part chunk 42 includes an information chunk 44 and a data chunk 44. Information chunk 44 includes a name 42*a*, a type 42*b*, a difficulty rating 42*c*, and a description 42*d*. The name 42*a* for the part 15*c* identifies it to user 16. Difficulty rating 42*c* and a description 44*d* further explain the standard performance 15 to user 16. Type 42*b* allows part 15*c* to be matched to appropriate virtual instruments: for instance, drum parts 15*c* to drum instruments.

The data chunk 44 contains MIDI data. The MIDI data is formatted into MIDI tracks. Track types include guide track 48*b*, performance track 48*a*, cue track 48*c*, score track 48*d*, local accompaniment track 48*e*, video track 48*f*, and DA guide track 48*g*.

GUIDE TRACK

Guide track 48*b* is a non-interactive complement to an interactive part 15*c*. Guide track 48*b* encodes the portion of a standardized performance 15 corresponding to a part 15*c*. User can toggle the playback of guide track 48*b* on and off manually. In addition, the system can play guide track 48*b* automatically.

User 16 can configure system 10 such that a live performance has no user assigned to a given interactive part. When the audio content of that part is needed for the live performance, system 10 renders the audio content of the guide track 48*b* non-interactively—for instance, in lieu of an interactive rendering of performance track 48*a*.

Guide track 48*b* can be stored in several formats. Guide track 48*b* can include a synthesizer control stream, such as a MIDI stream, or a sound recording file 94, such as an MP3 file.

In addition to providing audio "fill" in the event that a user chooses not to play a virtual instrument, one or more guide tracks 48*b* can be selectively played to provide guide information to user 16. This guide information provides insight to the user concerning the pitch, rhythm, and timbre of the performance of that particular virtual instrument. For example, if user 16 is singing an unfamiliar song 15*a*, guide track 48*b* can be played in addition to the performance sung by user 16. User 16 would typically play this guide track 48*b* at a volume level lower than that of the vocals. (Alternatively, user 16 can listen to guide track 48*b* through headphones.) This guide track 48*b*, which is played softly behind the vocal performance rendered by user 16, assists the user in providing an accurate performance for that vocal virtual instrument. Guide track 48*b* can be used to provide guide information for non-vocal virtual instruments, as well.

PERFORMANCE TRACK

Performance track 48*a* encodes audio content that is the basis for the live performance of a part 15*c* when user provides acceptable input. Performance track 48*a* includes a MIDI stream. The note event values of the MIDI stream encode synthesizer inputs.

Virtual instruments need not have a performance track 48*a*. A part for a string input device 28 or a percussion input device 28 typically does have a performance track 48*a*. For such parts, interactive karaoke system 10 must generate a note having the appropriate pitch (as specified by performance track 48*a*) for each input stimulus received. User input for vocal parts, however, does not require system 10 to generate a note. Instead, user 16 provides vocal part inputs via a microphone 28*b* (shown in FIG. 5).

CUE TRACK

Broadly, cue track 48*c* indicates how and when system 10 should prompt user 16 for input during the live performance. The prompts do not have to correspond to the performance track 48*a* on a one-to-one basis. Instead, typically, the prompts summarize the performance track 48*a*. This summarizing helps system 10 simplify parts so that user 16 does not have to play every note in performance track 48*a*. Cues in cue track 48*c* can collect multiple notes or phrases from the performance track 48*a*. The mapping of individual stimuli to multiple notes is one way in which system 10 can create the illusion of a fuller performance than the stimuli strictly describe.

Cue track 48*c* specifies timing intervals during which the user is prompted for input stimuli. In general, cue intervals do not overlap.

The timing (both the start and duration) of a cue interval has several functions. It shows when a prompt should be displayed to the user. The interval also indicates sections of the performance track 48*a* that will be played if acceptable user input occurs during that window.

SCORE TRACK

Score track 48*d* encodes musical notations that are synchronized with the performance track 48*a* for display during a live performance. The notations can take several forms. One form is textual descriptions of chords, such as "F#5" or "C5". Notations can also describe conventional musical notations, for instance staff or tablature.

Figure 12A:
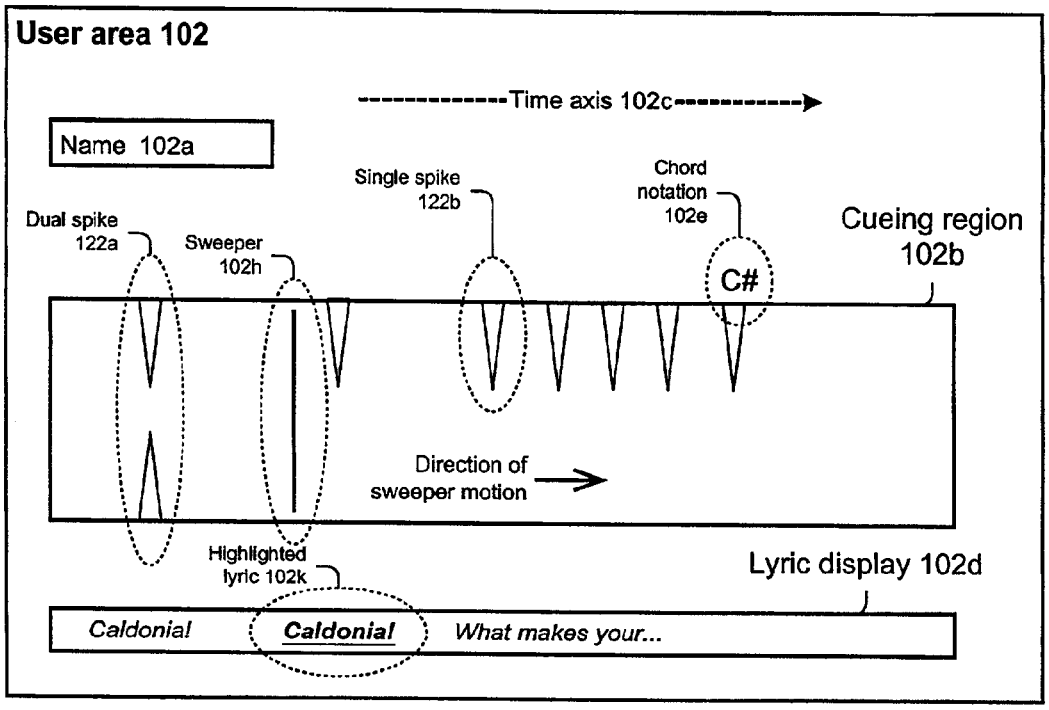
FIG. 12A is a first diagram of a user area.
Figure 12B:
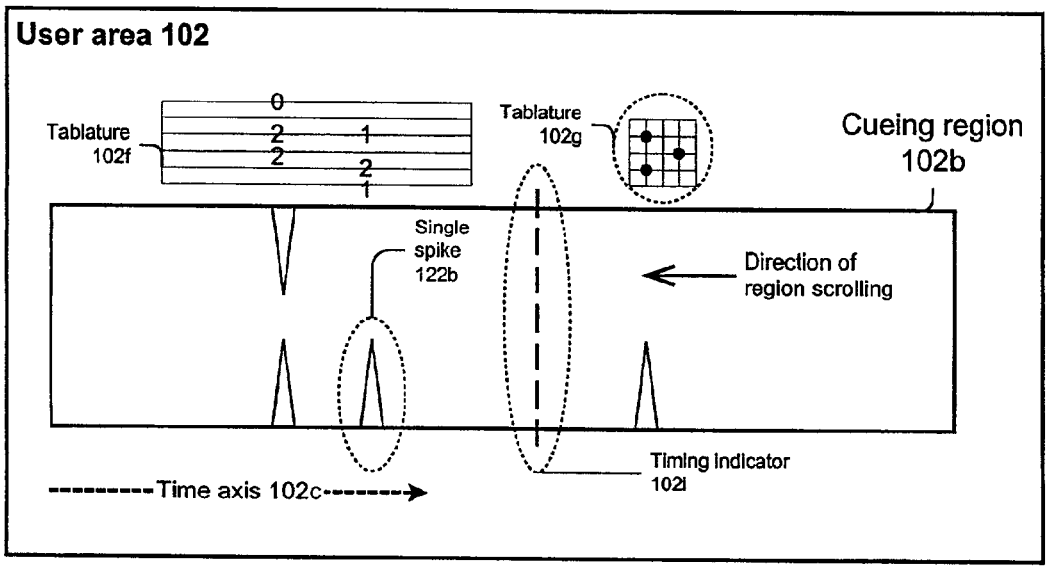
FIG. 12B is a second diagram of a user area.

Examples of displayed notations are discussed with regard to FIG. 12A and FIG. 12B.

LOCAL ACCOMPANIMENT TRACK

Local accompaniment track 48*e* within a virtual instrument part 15*c* is distinct from the global accompaniment. Local accompaniment track 48*e* provides additional audio "fill" for the virtual instrument part as needed. Using local accompaniment track 48*e*, system 10 can create the audio illusion that the user is playing an entire instrument part, when in fact the input stimuli only correspond to a portion of the standardized performance 15 of the part. The standardized performance 15 can be a combination of the performance track 48*a* and the local accompaniment track 48*e*.

As an example, consider a drum kit. As a physical device, a drum kit can be fairly complex, involving several percussion instruments. Some skilled drummers can play with two hands and two feet separately and simultaneously. The input device 28 that the user of system 10 manipulates can be much simpler, even to the extent that the simpler input device 28 makes it difficult or impossible for the user to recreate exactly through the single device 28 the many interactions that a professional drummer might make with a full drum kit in real time. Local accompaniment track 48*e* allows user 16 to play a subset or an approximation of the total notes in the part and to have the rest of the notes provided anyway. For instance, in the drum example, one option is for the user 16 to just play the snare-drum part, while an accompaniment track within the VI track provides kick drum, tom-tom, high hat, and so forth.

In performance, as with performance track 48*a*, during periods when user is not providing acceptable input, system 10 does not render the audio content of local accompaniment track 48*e*.

VIDEO TRACK

Video track 48*f* provides interactive visuals synchronized to the live performance. Video track 48*f* includes a time-encoded series of visual frames for system 10 to present to user 16 in response to user interaction. For instance, automated music training can benefit from video response. Video track 48*f* can include a stock series of pictures or movies, coordinated to certain points in standardized performance 15. For instance, the video track 48*f* can depict a turntable for a deejay application. In this case, for a given standardized performance 15, the video track 48*f* can offer a different, customized version of a turntable.

DA GUIDE TRACK

Conceptually, the DA guide track 48*g* is similar to the guide track 48*b* but operates specifically with digital audio clips. DA guide track 48*g* uses MIDI control messages to point to digital audio clips, indexed in the DA trigger chunk 38*c* and stored in the DA chunk 38*d*. DA guide track 48*g* includes a time-encoded series of trigger intervals. The trigger intervals indicate when a given clip should be played. The note number indicates which clip to play, the note placement in time indicates when to play it, and the note duration indicates for how long to play it. DA guide track 48*g* is useful at least when the standardized performance 15 includes audio content that cannot be synthesized satisfactorily, such as with a particular vocal performance or, in general, any performance with unusual or distinctive sonic qualities.

One efficient use of sound recordings, or digital audio clips, exploits the fact that many standardized performances 15 include redundancy. For example, background tracks often contain repeated musical passages, or large portions of silence, or both. Therefore, these background tracks can be broken into discrete clips, each of which represents a first instance of each repeated portion, making subsequent repeated instances obsolete. Thus, storage space and bandwidth are not wasted saving redundant passages. During playback, these clips can be rendered repeatedly by referencing each appropriate clip at an appropriate time. For example, if a standardized performance 15 has five identical fifteen second background choruses and these five choruses are each separated by forty-five seconds of silence, this background track recorded in it entirety would be four minutes and fifteen seconds long. However, there is only fifteen seconds of unique data is this track, in that this chunk of data is repeated five times. Accordingly, by recording only the unique portions of data, a four minute and fifteen second background track can be reduced to only fifteen seconds, resulting in a 94% file size reduction. By utilizing a MIDI trigger file to initiate the timed and repeated playback of this fifteen second data track (once per minute for five minutes), a background track can be created which has the space saving characteristics of a MIDI file yet the robust sound characteristics of a MPEG file.

DEVICES

Figure 4:
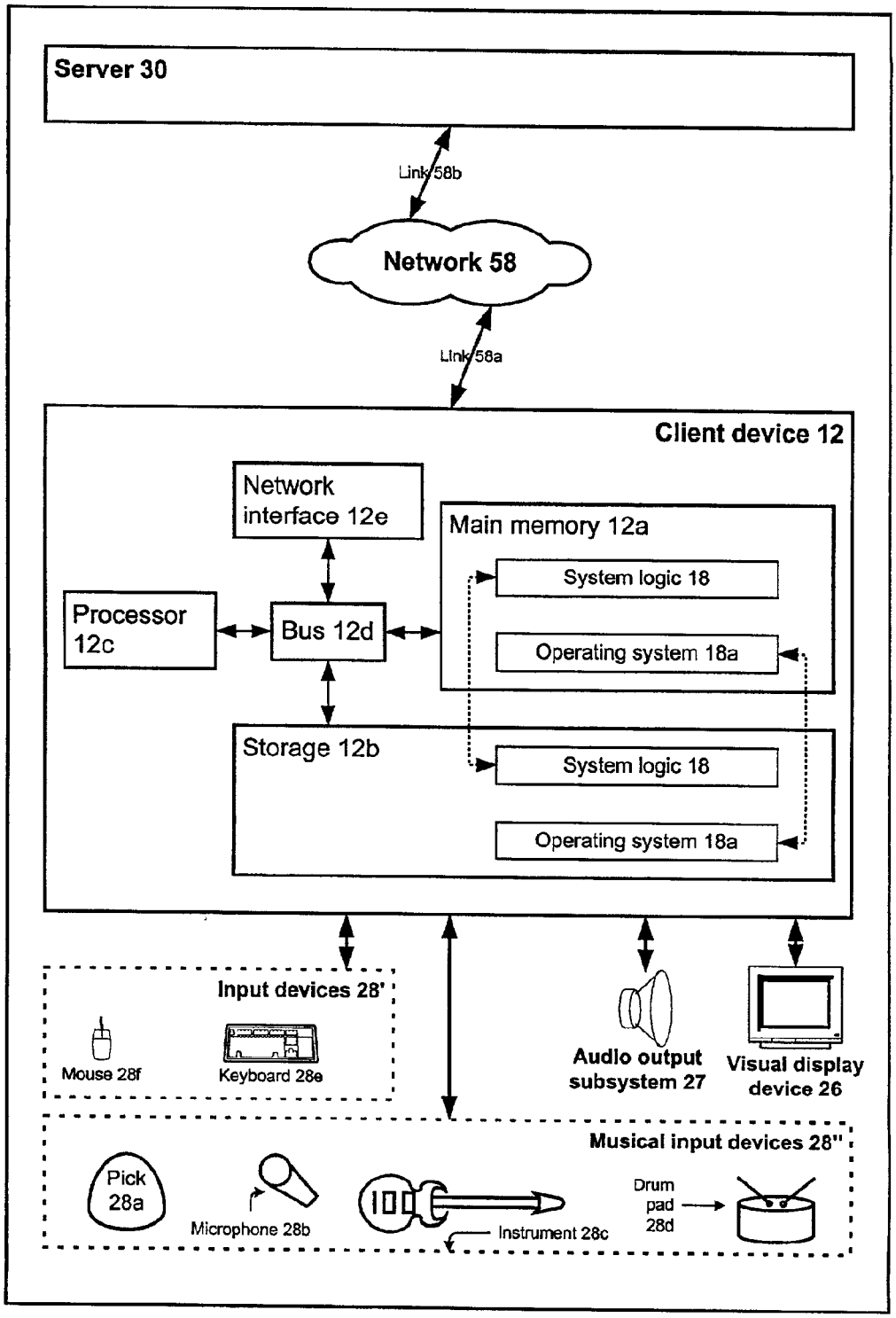
FIG. 4 is a block diagram of a client device and connected devices.

Referring now to FIG. 4, a client device 12 executes system logic 18 of karaoke system 10. In this embodiment, client device 12 is a personal computer. Client device 12 includes main memory 12*a*, storage 12*b*, and a processor 12*c*, interconnected by a bus 12*d*. Storage 12*b* is a non-volatile storage medium such as a disk drive. Processor 12*c* executes machine-readable instructions stored in main memory 12*a* or in storage 12*b*, or both, according to operating system 18*a*. Bus 12*d* carries communications between components of the client device 12.

In this embodiment, operating system 18*a* is a Microsoft Windows operating system such as Windows 98, Windows 98SE, Windows ME, Windows 2000, Windows XP, or other compatible operating systems.

Audio output subsystem 27 includes components for the reproduction of sound under the control of processor 12*c*. In client device 12 this typically includes a sound card, a loudspeaker or headphones, and an amplifier, together with software drivers for operating the sound card with the operating system 18*a*.

Client device 12 optionally includes a network interface 12*e*, which enables communication by client device 12 across a network 58 via a link 58*a*. Example network interfaces 12*e* include an Ethernet transceiver or a modem. Network interface 12*e* is typically present, at least so that client device 12 can communicate with server 30, which is a computing device distinct from client device 12 and which uses a link 58*b* to communicate via network 58. Client device 12 can download files 14 from server 30.

Client device 12 also includes a visual display device 26 and one or more input devices 28. Visual display device 26 is a computer screen. There can be several input devices 28 (shown in FIG. 1A), including common personal computer peripheral input devices 28', such as a QWERTY keyboard 28*e*, mouse 28*f*, or touch-sensitive screen (not shown). Other types of input device 28 include musical input devices 28", such as string input device 28*a* (e.g., an electronic guitar pick for a virtual guitar or for a virtual bass guitar), microphone input device 28*b*, percussion input device 28*d* (e.g., an electronic drum pad for a virtual drum), or MIDI-enabled instrument input device 28*c* (e.g. an electronic piano, guitar, etc.). Both musical and non-musical devices can be used as input devices 28 to system 10. For example, a user 16 can provide input stimuli to a part by tapping on the space bar of a QWERTY keyboard 28*e*.

Client device 12 includes input ports (not shown) for various virtual instrument input devices 28. These virtual instrument devices are the subject of U.S. Pat. No. 5,393,926, entitled "Virtual Music System", filed Jun. 7, 1993, issued Feb. 28, 1995, and herein incorporated by reference. Further, these virtual instrument input devices 28 and virtual instruments are the subject of U.S. Pat. No. 5,670,729, entitled "A Virtual Music Instrument with a Novel Input Device", filed May 11, 1995, issued Sep. 23, 1997, and incorporated herein by reference.

In the present embodiment, the virtual pick devices 28*a* are USB devices.

SOFTWARE ARCHITECTURE

Figure 5:
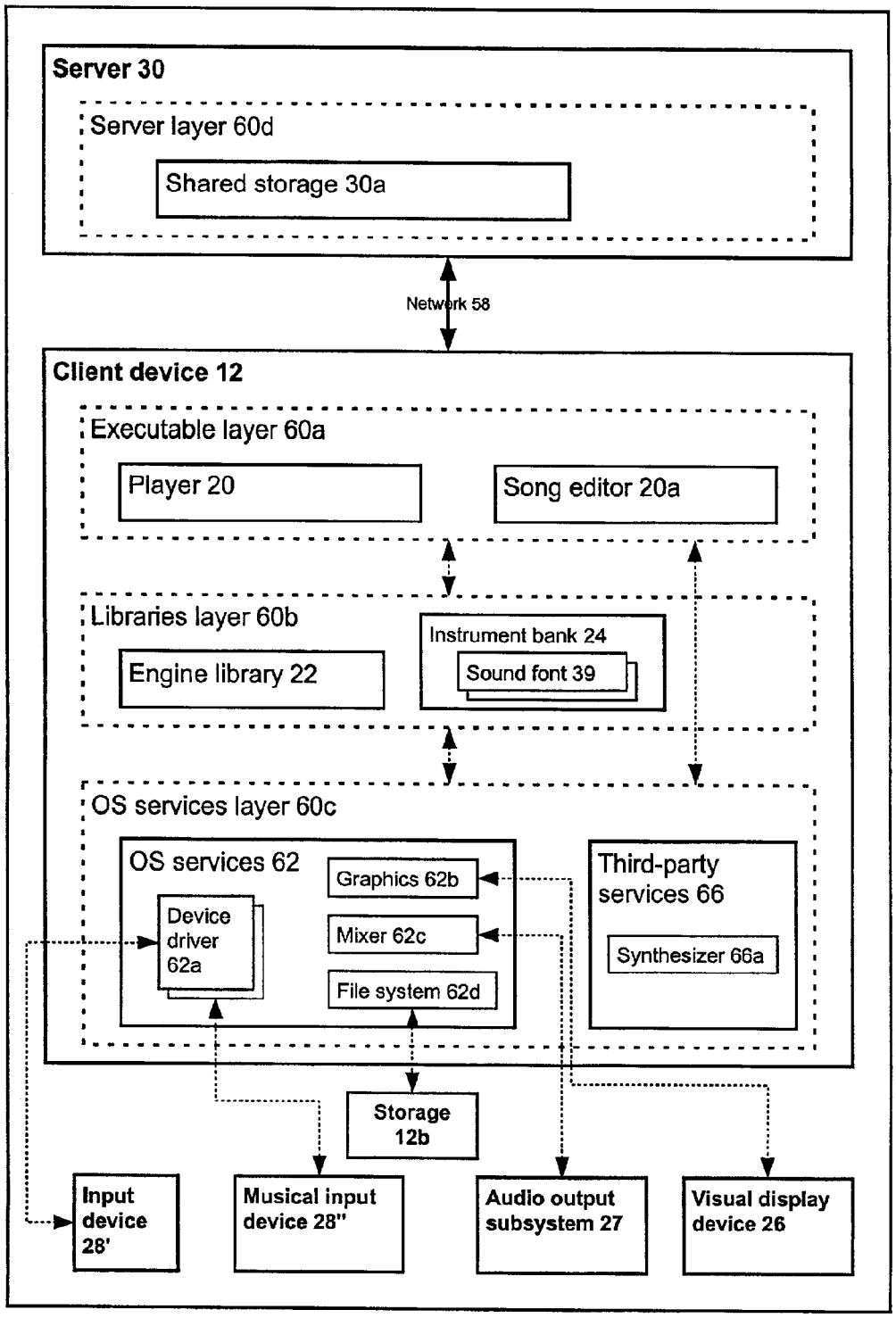
FIG. 5 is a block diagram of software layers.

Referring now to FIG. 5, software components of system 10 have a layered architecture. In general, the layers collect software components according to function.

Server layer 60*d* is due to a client/server division of services. Server layer 60*d* includes services of server 30 that are remote relative to client device 12, such as shared storage 30*a*. System 10 communicates with components of server layer 60*d* across network 58.

Layers local to client device 12 include an executable layer 60*a*, a libraries layer 60*b*, and an operating system (or "OS") services layer 60*c*. Executable layer 60*a* includes player 20 and a song editor 20*a*. In this embodiment, which uses a Microsoft Windows operating system 18*a*, player 20 is a ".EXE" file. In other words, player 20 is an application executable by operating system 18*a*. Player 20 is the primary executable involved in playing back files 14.

The libraries layer 60*b* includes an engine library 22. In this embodiment, which uses a Microsoft Windows operating system 18*a*, engine library 22 is a dynamically linked library, or "DLL". Engine library 22 contains instructions and data that supplement the computing instructions of player 20. Player 20 loads engine library 22 automatically.

The libraries layer 60*b* also includes auxiliary files such as instrument bank 24. Instrument bank 24 contains sound fonts 39, independent of sound fonts 39 stored in data file 14. For example, instrument bank 24 can act as a library of available sound fonts 39 that is pre-installed along with player 20.

Though both the engine library 22 and the instrument bank 24 are referred to as "libraries", they are conceptually different at least in that engine library 22 contains executable instructions and instrument bank 24 does not. Instrument bank 24 is a data file or document, used by system logic 18. In general, the layered architecture of system logic 18 reflects standard practices for the operating system 18*a* and active software (i.e., instructions that are executable).

Broadly, OS services layer 60*c* includes services that can be used or shared by applications running on the operating system 18*a*, including services that are part of operating system 18*a*. In particular, OS services layer 60*c* includes OS services 62 and third-party services 66. OS services 62 are part of operating system 18*a* (shown in FIG. 4). OS services 62 include device drivers 66*a*, a graphics applications programming interface (API) 66*b*, an audio mixer API 66*c*, and a file system 66*d*. The graphics API 66*b*, for instance, enables system 10 to use visual display device 26. Audio mixer API 66*c* enables system 10 to use audio output subsystem 27. File system 66*d* enables system 10 to use storage 12*d*. Device drivers 66*a* handle low-level communications with input devices 28, typically shielding components of system 10 from having to manage such low-level communications, while device drivers 66*a* act as a gateway for communications at a high level.

Third-party services 66 include an audio synthesizer 66*a*. Audio synthesizer 66*a* can read a MIDI stream and render it as audio via audio output subsystem 27.

CLASSES AND INTERFACES

Figure 6A:
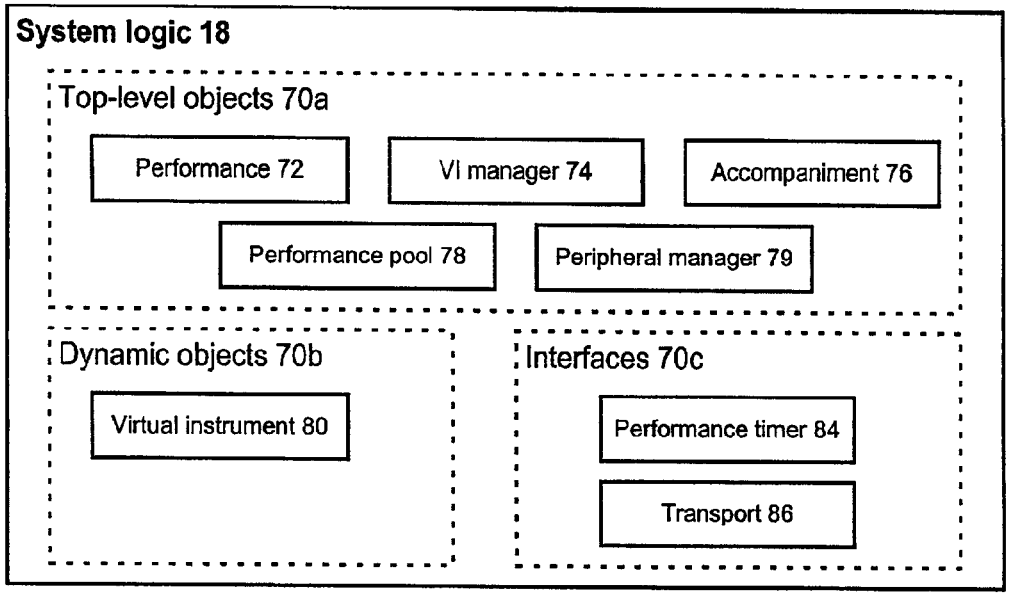
FIG. 6A is a block diagram of object classes and interfaces.

Referring now to FIG. 6, system logic 18 includes classes that define software objects. System logic 18 also includes interfaces that are implemented in the classes. In general, the classes specify behaviors and properties. A class definition provides enough information for an object-oriented runtime process, such as system logic 18, to generate an object. The generated object is an instance of the class and is said to belong to that class. An object that belongs to a class implements the behaviors and properties of that class. An interface specifies a collection of behaviors. A class defines an implementation of an interface. Typically, both classes and objects from such classes are said to implement an interface.

One use of an interface is to standardize a common set of behaviors. Different types of objects can each implement the same interface. This simplifies manipulations of such disparate objects, as the common interface imposes consistency. In addition, in some object oriented languages such as Java, an object that implements an interface can be referenced via its interface implementation, as distinct from a reference to the object as a whole.

This description and these figures focus on objects. The class definitions of such objects are understood to be available to system logic 18.

System logic 18 includes top-level objects 70*a*, dynamic objects 70*b*, and interfaces 70*c*. Top-level objects 70*a* include performance object 72, VI manager object 74, global accompaniment object 76, performance pool object 78, and peripheral manager object 79. In general, top-level objects 70*a* define objects that are generated when system 10 is initialized. Dynamic objects 70*b* include virtual instrument object 80. Interfaces 70*c* include performance timer interface 84 and transport interface 86.

SYSTEM BEHAVIOR

Figure 6B:
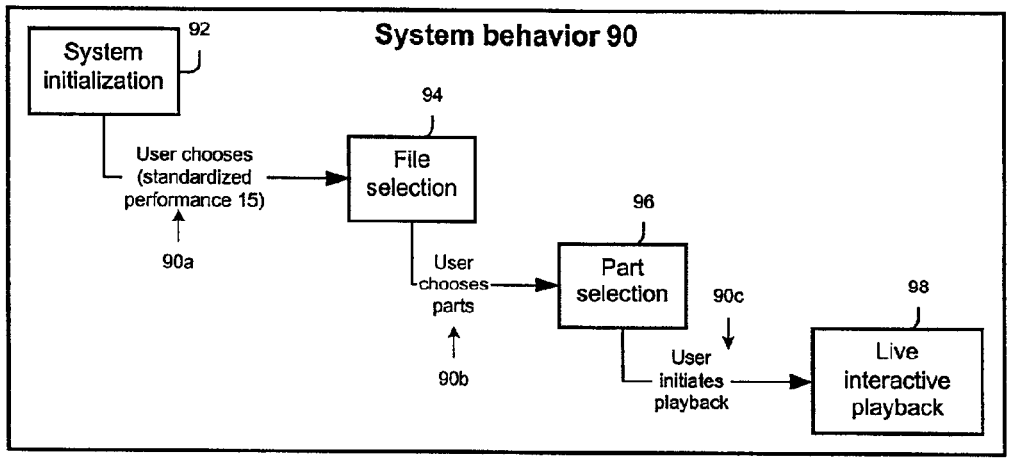
FIG. 6B is a flowchart of system behavior.

Referring now FIG. 6B, system logic 18 includes system behavior 90. In general, system behavior 90 includes procedures for selecting a multipart file 14 and playing back the associated live performance, in response to user input.

System behavior 90 initializes objects and settings of system 10 (process 92). Once user 16 chooses a standardized performance (process 90*a*), system behavior 90 selects a corresponding multipart data file 14 and prepares related objects (process 94), as will be explained. Once user 16 chooses parts to interact with (process 90*b*), system behavior 90 configures corresponding virtual instrument objects 80 (process 96). Next, user initiates playback (process 90*c*) and system behavior 90 begins live interactive playback process 98.

SYSTEM INITIALIZATION

Figure 6C:
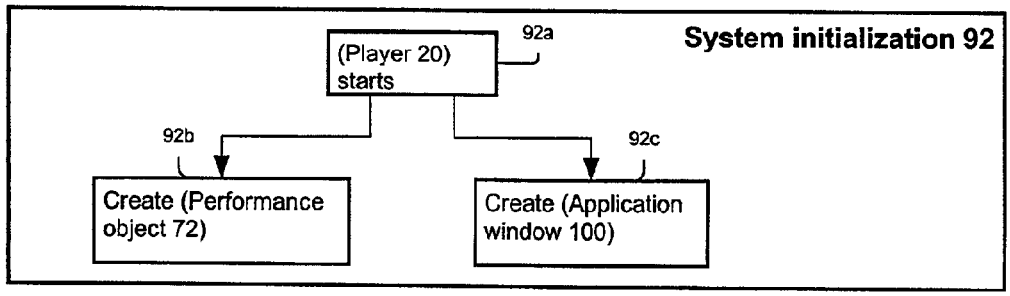
FIG. 6C is a flowchart of system initialization.

Referring now FIG. 6C, system initialization 92 includes starting the player 20 (process 92*a*), for example when operating system 18*a* loads player 20 for execution by processor 12*c*. For instance, player 20 can start when user 16 uses a mouse input device 28 and a graphical user interface (GUI) shown in the visual display device 26 to double-click on an icon for the player 20.

Next, system initialization 92 creates a performance object 72 (process 92*b*). As will be explained, performance object 72 generates and initializes other top-level objects 70*a*, except that the VI manager object 74 creates a peripheral manager object 79 to help coordinate the creation and operation of virtual instrument objects 80.

System initialization 92 launches an application window 100 (process 92*c*).

PERFORMANCE

In general, a performance object 72 represents a live performance of a standardized performance 15 and includes properties and behaviors to manage the live performance. Performance object 72 is the first top-level object 70*a* to be instantiated. Performance object 72 launches other top-level objects 70*a*.

Figure 7A:
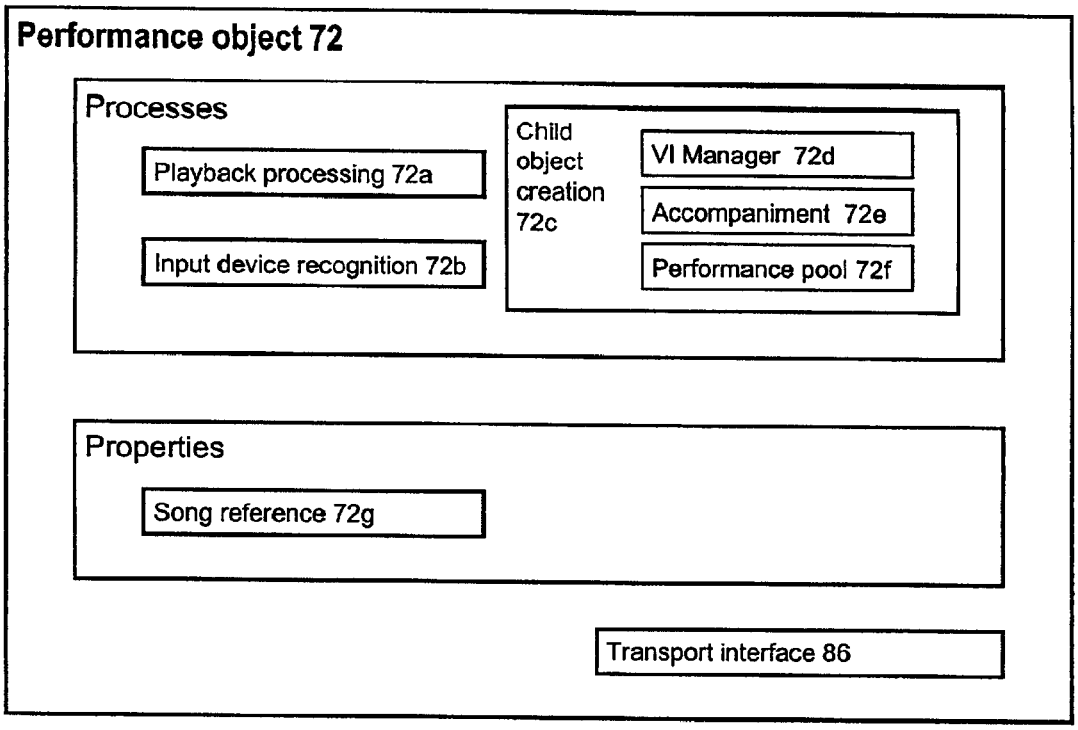
FIG. 7A is a block diagram of a performance object.

Referring now to FIG. 7A, performance object 72 includes a process for child object creation 72*c*. Performance object 72 also includes properties such as a song reference 72*g*, which specifies the standardized performance 15 to perform.

Child object creation 72*c* is invoked when performance object 72 is created. Child object creation 72*c* includes processes such as VI Manager launch 72*d*, accompaniment launch 72*e*, and performance pool launch 72*f*. VI Manager launch 72*d* creates a VI manager object 74. Accompaniment launch 72*e* creates a global accompaniment object 76. Performance pool launch 72*f* creates a performance pool object 78. Each of these objects (VI manager object 74, global accompaniment object 76, and performance pool object 78) created by the performance object 72 is singular to that performance object 72.

Performance object 72 also implements a transport interface 86, described with reference to FIG. 15A and FIG. 15B, respectively.

APPLICATION WINDOW

Figure 8A:
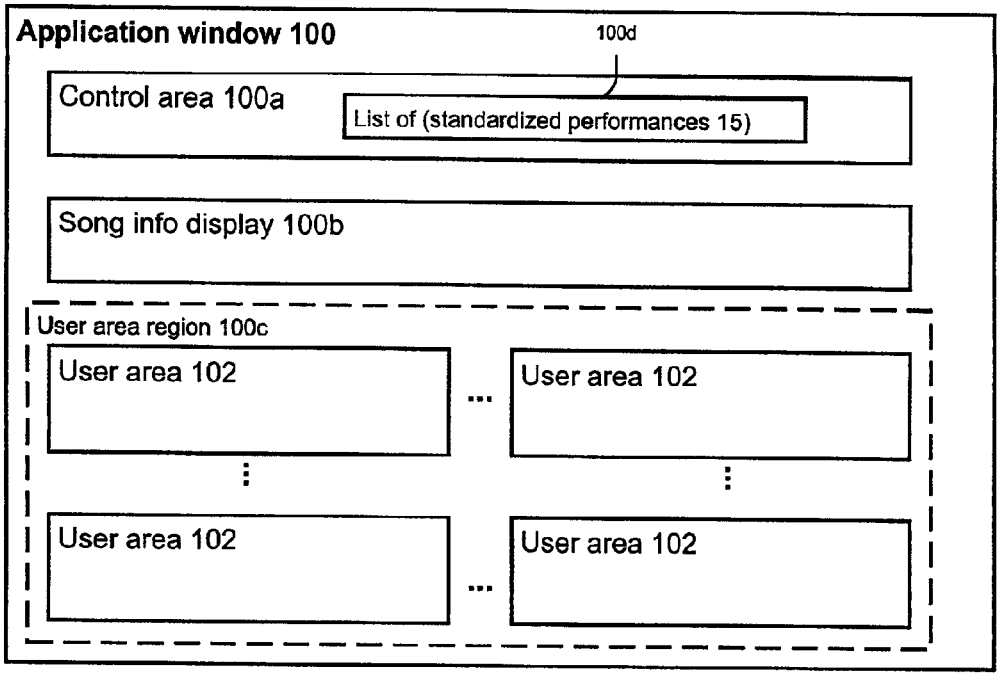
FIG. 8A is a diagram of an application window.

Referring now FIG. 8A, player 20 has an application window 100 in the GUI managed by operating system 18*a*. Application window 100 includes a control area 100*a*. The user 16 interacts with the control area 100*a* to select a standardized performance 15 from a list 100*d* of standardized performances 15 performable on system 10. List 100*d* displays, for each available standardized performance 15, information stored in the song information 36 (shown in FIG. 2) of corresponding data file 14. User 16 accesses and navigates list 100*d*via the GUI. List 100*d* can show those standardized performances 15 for data files 14 already downloaded from remote music server 30. Additionally, list 100*d* can include standardized performances 15 for data files 14 available from remote music server 30.

Application window 100 also includes a song info display 100*b* and a user area region 100*c*. Song info display 100*b* displays information stored in the song information 36 of a currently selected standardized performance 15. User area region 100*c* includes one or more user areas 102, each of which corresponds to a part playable by a user 16. During a live performance, when each user interacting with karaoke system 10 is paired to part 15*c*, each such user 16 receives visual feedback appropriate to his or her part in a user area 102 dedicated to that user 16.

PERIPHERAL MANAGER

Figure 8B:
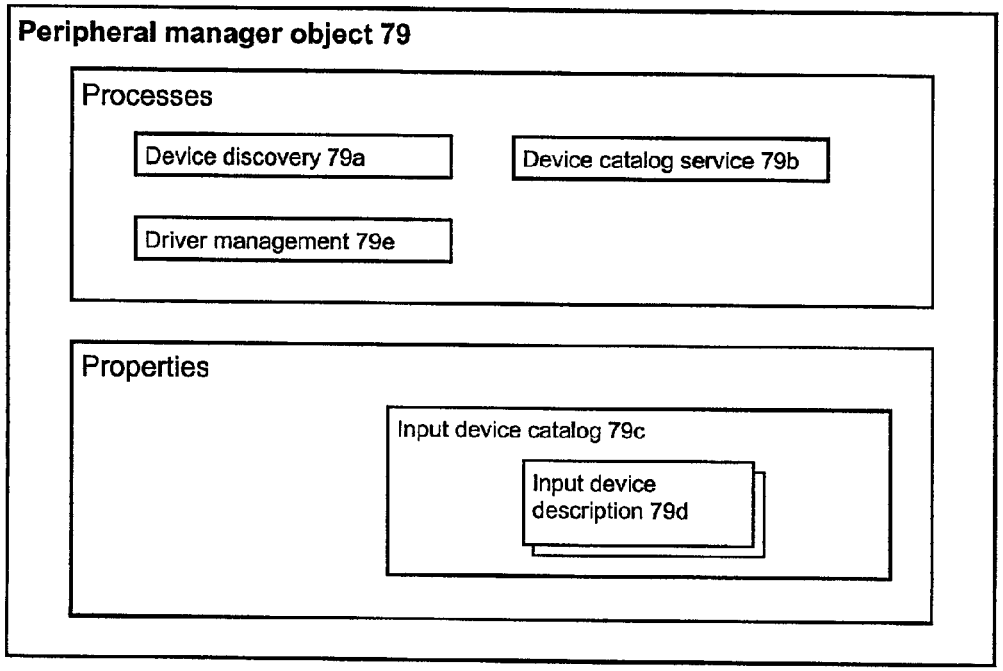
FIG. 8B is a block diagram of a peripheral manager object.

Referring to FIG. 8B, peripheral manager object 79 includes processes such as device discovery 79*a*, device catalog service 79*b*, and driver management 79*e*. Peripheral manager object 79 also includes properties such as input device catalog 79*c*, which contains input device descriptions 79*d*.

Device discovery 79*a* is invoked at runtime to discover input devices 28 attached to client device 12. Device discovery 79*a* stores information about such input devices 28 in input device descriptions 79*d*. Device catalog service 79*b* makes the contents of input device catalog 79*c* available to other objects such as virtual instrument objects 80. Driver management 79*e* interacts with device drivers 62*a* (shown in FIG. 5) to communicate with input devices 28.

VI MANAGER OBJECT

In general, a VI manager object 74 manages a collection of virtual instrument objects 80. Typically, each such virtual instrument object 80 represents a different part of the audio content of standardized performance 15.

Figure 9A:
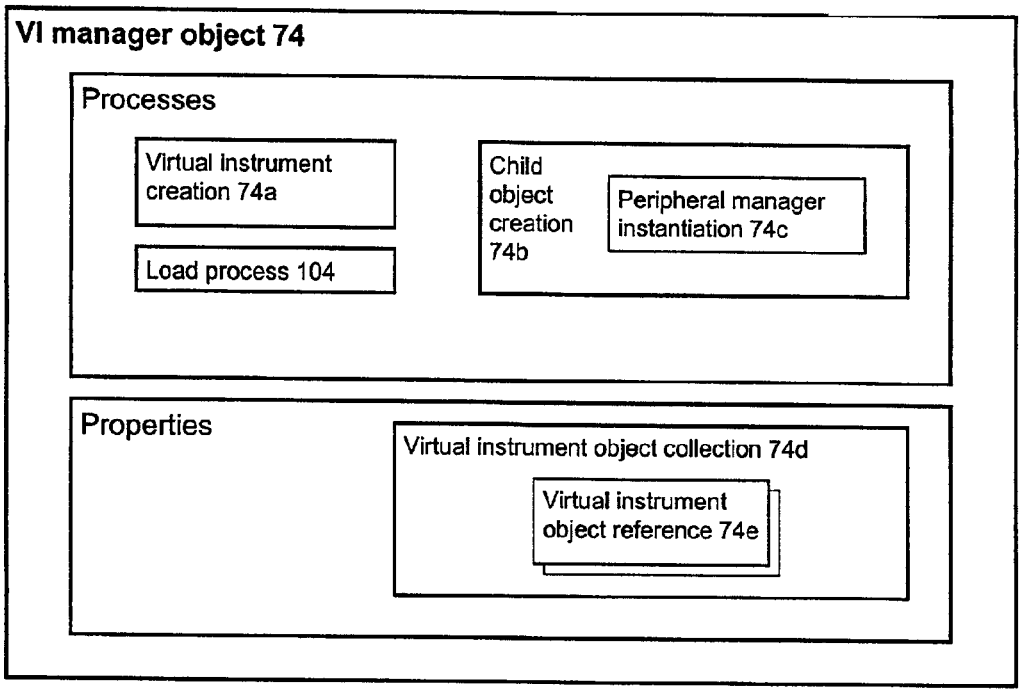
FIG. 9A is a block diagram of a virtual instrument manager.

Referring now to FIG. 9A, a VI manager object 74 includes processes such as virtual instrument creation 74*a*, child object creation 74*b*, and load process 104. VI manager object 74 also includes properties such as a virtual instrument object collection 74*d*, which contains a reference 74*e* for each virtual instrument object 80 created by VI manager object 74.

VI manager object 74 is instantiated during system initialization 92. Automatically upon being instantiated, VI manager object 74 performs child object creation 74*b*. Child object creation 74*b* instantiates a peripheral manager object 79 process 74*c*). Load process 104 occurs when user 16 selects a song 15*a*, as part of file selection 94, as will be explained.

Figure 9B:
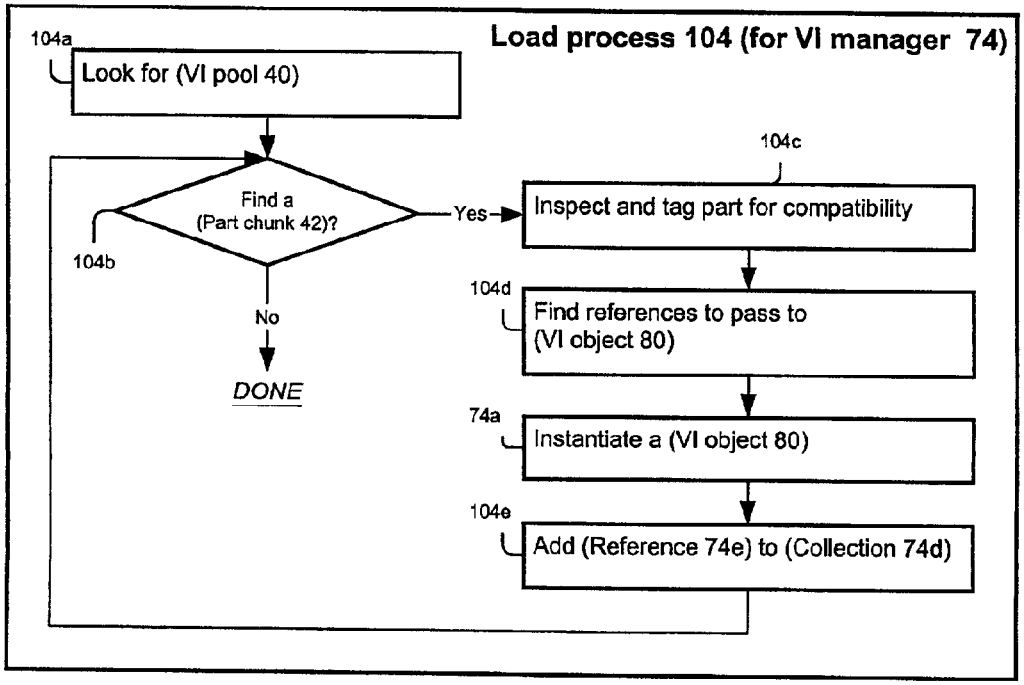
FIG. 9B is a flowchart of a VI manager load process.

Referring now to FIG. 9B, load process 104 looks in file 14 for a VI pool 40 (process 104*a*). Next, load process 104 looks in VI pool 40 for part chunks 42 (process 104*b*). Load process 104 examines multipart data file 14 to determine which virtual instruments need to be generated. In particular, load process 104 scans the information chunk 44 (shown in FIG. 3) of each part chunk 42 (process 104*c*). Load process 104 find a reference that specifies the current part chunk 42 (process 104*d*) and passes that reference when it instantiates a virtual instrument object 80 to correspond to that part chunk 42 (process 74*a*). Load process 104 also adds (to collection 74*d*) a reference 74*e* to the new virtual instrument object 80 (process 104*e*). Load process 104 loops for each part chunk 42 in VI pool 40 (process 104*b*) and exits afterward.

FILE SELECTION

Figure 10A:
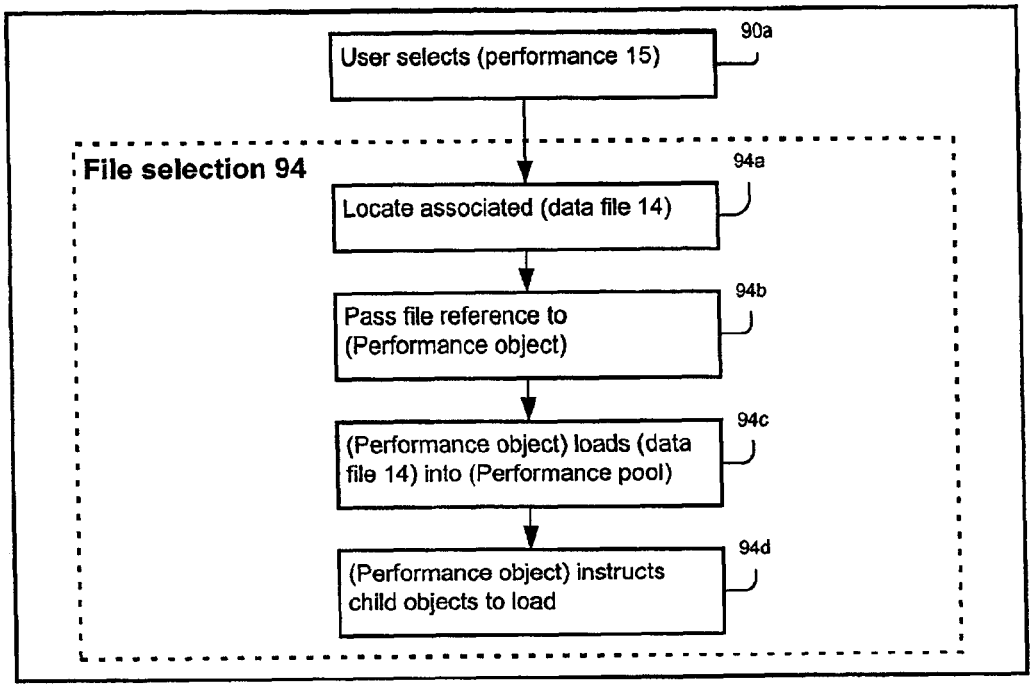
FIG. 10A is a flowchart of a file selection process.

Referring now to FIG. 10A, user 16 selects a standardized performance 15 (process 90*a*, shown in FIG. 6B). File selection 94 locates the corresponding data file 14

(procedure 94*a*). File selection 94 passes a file reference that specifies the data file 14 to performance object 72 (procedure 94*b*). For instance, the file reference can be a file name within filing system 62*d* (shown in FIG. 5). Using the file reference, the performance object 72 causes the performance pool object 78 to load the data file 14 (procedure 94*c*). The performance object 72 uses load process 104 to instruct its child objects to load (procedure 94*d*).

When user 16 wishes to perform a standardized performance 15 available on database of remote music server 30, or when an administrator wishes to add a standardized performance 15 to list 100*d*, interactive karaoke system 10 downloads the appropriate multipart data file 14 from server 30.

PART SELECTION

Figure 10B:
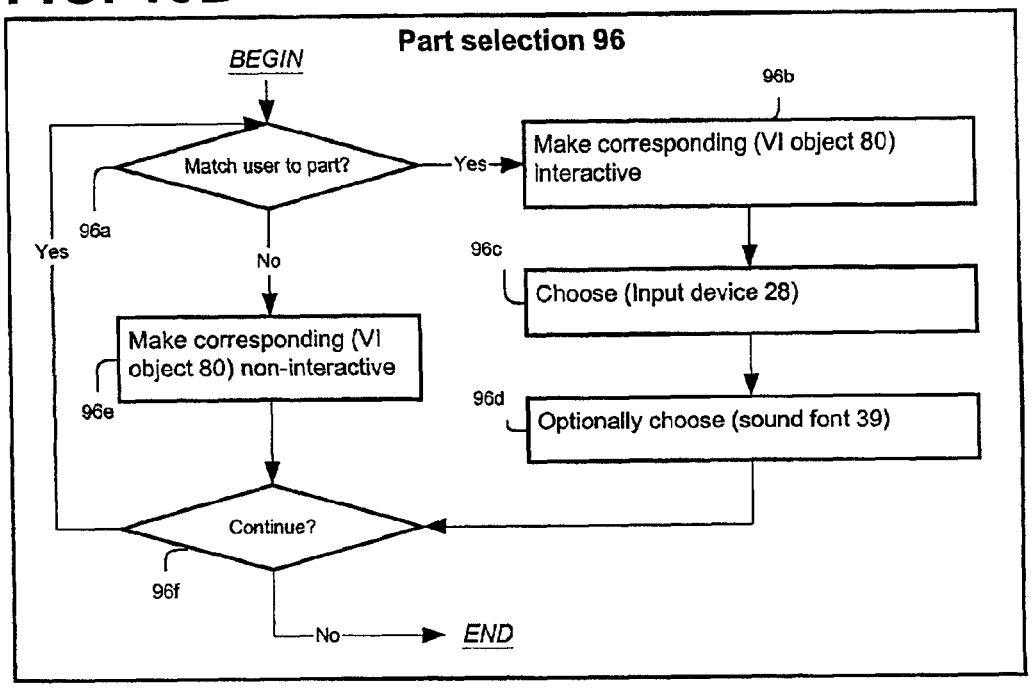
FIG. 10B is a flowchart of a part selection process.

Referring now to FIG. 10B, available virtual instruments are presented to user 16 in the form of a list displayed in application window 100. Part selection 96 responds to user interactions with that list and related GUI controls in application window 100. In general, part selection 96 allows zero or more users 16 to select parts to play. If no users 16 are paired with parts, system 10 can use guide tracks 48*b* to render the standardized performance 15. If multiple users 16 are paired with parts, a virtual band is created.

If a user indicates he wants to play a part (process 96*a*), part selection 96 makes the corresponding virtual instrument object 80 interactive (96*b*). Part selection 96 then uses the GUI to prompt the user 16 to choose an input device 28 (process 96*c*) and a sound font 39 (process 96*d*). Note that processes 96*c* and 96*d* are optional, as the part chunk 42 has a default input device 28 and sound font 39 that can be deduced from type 44*b*. Process 96*d* allows user 16 to override the default sound font 39. An example of process 96*c* is the user 16 choosing a guitar pick 28*a* to play a drum part.

If a user indicates he does not want to play a part (process 96*a*), part selection 96 makes the corresponding virtual instrument object 80 non-interactive (96*e*). Part selection 96 repeats these choices (process 96*f*) for as many users 16 choose to play parts, subject to the number of available input devices 28.

PLAYBACK

Figure 7B:
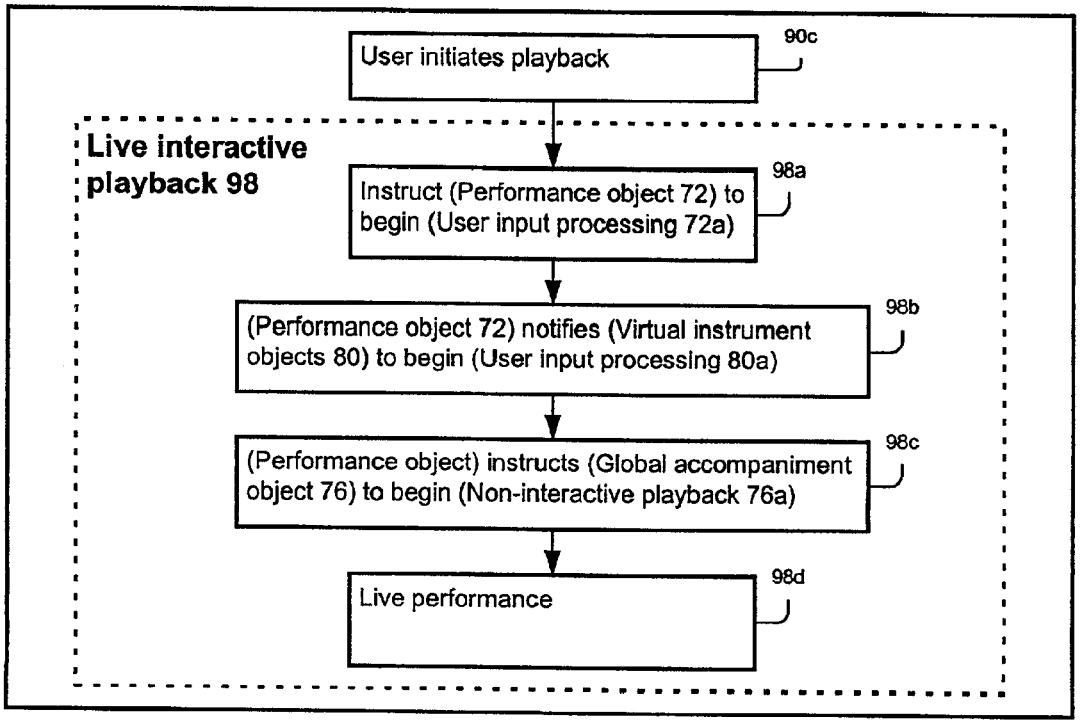
FIG. 7B is a flowchart of a live interactive playback process.

Referring now to FIG. 7B, user 16 instructs system to begin a live interactive playback process 98 (process 90*c*). Live interactive playback process 98 instructs performance object 72 to begin playback processing 72*a* (process 98*a*). Playback processing 72*a* then instructs virtual instrument objects 80 each to begin user input processing 80*a* (process 98*b*). Playback processing 72*a* also instructs global accompaniment object 76 to begin non-interactive playback 76*a* (process 98*c*). Virtual instrument objects 80 and global accompaniment object 76 operate separately during live performance (process 98*d*) until the standardized performance 15 is complete or is interrupted by user 16.

VIRTUAL INSTRUMENT OBJECT

Figure 11A:
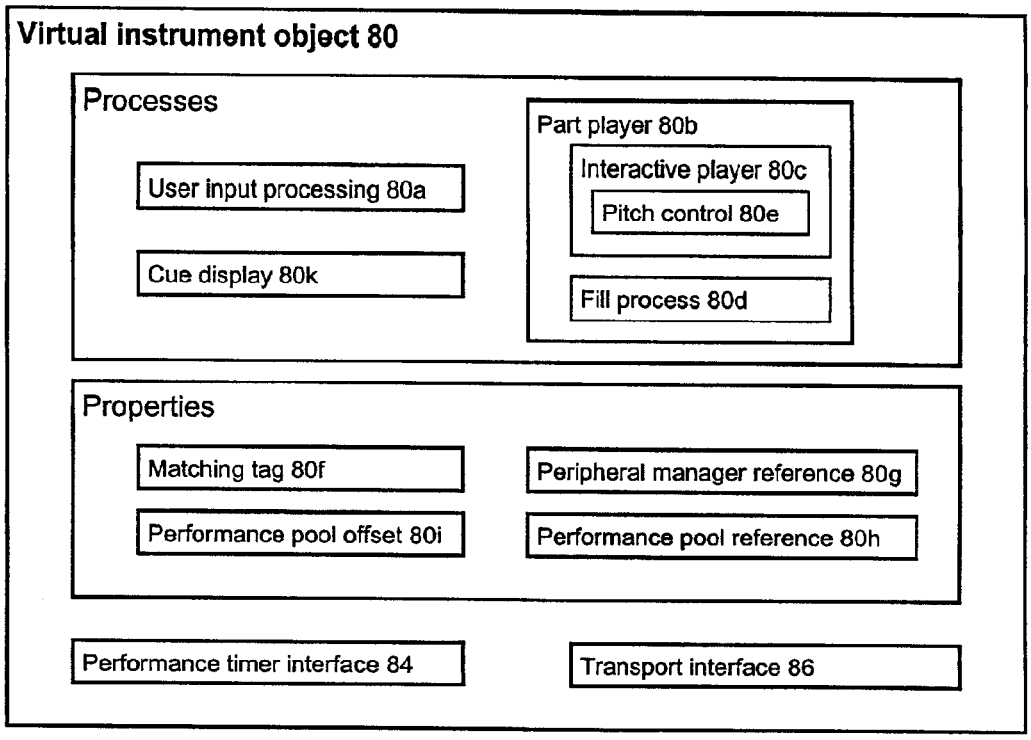
FIG. 11A is a block diagram of a virtual instrument object.

Referring now to FIG. 11A, a virtual instrument object 80 includes processes such as user input processing 80*a*, part player 80*b*, and cue display 82. Virtual instrument object 80 also includes properties such as a matching tag 80*f*, a peripheral manager reference 80*g*, a performance pool reference 80*h*, and a performance pool offset 80*i*.

Virtual instrument object 80 has a reference to a performance timer interface 84 on global accompaniment object 76. Virtual instrument object 80 also implements a transport interface 86, described with reference to FIG. 14A and FIG. 14B, respectively.

Virtual instrument object 80 is interactive, i.e., responds to user input stimuli during a live performance. User input processing 80*a* handles these interactions, correlating these stimuli to prompting data encoded in cue track 48*e*. Peripheral manager reference 80*g* specifies peripheral manager object 79, which enables communication with an input device 28.

Virtual instrument object 80 presents visual feedback to user 16 via cue display 82.

Matching tag 80*f* specifies types of musical input devices 28" that are recommended for use with virtual instrument object 80. Input devices 28 are represented in input device catalog 79*c* (shown in FIG. 8B).

Virtual instrument object 80 reads performance track 48*a* (shown in FIG. 15C) and other tracks via the performance pool object 78. Performance pool reference 80*h* and performance pool offset 80*i* specify the location of the relevant performance track 48*a*.

Part player 80*b* includes an interactive playback process 80*c* and a fill process 80*d*. Interactive playback process 80*c* renders audio content of the performance track 48*a* and (when such content is present) renders the local accompaniment track 48*e* and video track 48*f*. Fill process 80*d* renders guide track 48*b* and DA guide track 48*g*. Regardless of the parts 15*c* that user 16 chooses to play, interactive karaoke system 10 can render a live performance which does not have any un-played parts 15*c*, as fill process 80*d* fills in any missing performances.

During a live performance, user 16 provides input stimuli to one or more of these virtual instrument input devices 28. These input stimuli generate one or more input signals, each of which corresponds to one of the virtual instrument input devices 28. The form of input stimulus provided by user 16 varies with the type of input device 28 and virtual instrument that user 16 is playing. For parts that utilize an electronic guitar pick 28*a* (shown in FIG. 4), user 16 typically provides an input stimulus by swiping the virtual guitar pick 28*a* on a hard surface. For percussion parts that use an electronic drum pad 28*d*, user 16 typically strikes the drum pad with a hard object. For vocal parts, user 16 sings into a microphone 28*b*.

Part player 80*b* maps the input signal received by a particular virtual instrument object 80 to notes for audio output in accordance with audio content encoded in performance track 48*a*. However, user 16 might provide these input stimuli early or late in time, relative to timing indicia. Or, user 16 might provide a different number of input stimuli that audio content specifies. Accordingly, for each pitch control indicia 96, part player 80*b* determines a time window during which any input stimulus received from the corresponding virtual instrument is mapped to audio content of performance track 48*a* for that time period. For example, if user 16 strums a virtual guitar pick 28*a* three times in the time window (each strum being a stimulus), part player 80*b* would render three samples of the corresponding audio content, even if the audio content specifies continuous, sustained sound during that time. This allows user 16 to improvise and customize their performance.

In addition to controlling the pitch of the specific notes played by a user, part player 80*b* sets the acoustical characteristics of each virtual instrument in accordance with the sound font 39 for that particular virtual instrument.

While vocals do not require any processing and are simply replayed by interactive karaoke system 10, input stimuli provided to non-vocal virtual instrument objects 80 (e.g., ones representing guitars, basses, or drums) are processed so that one or more notes, each having a specific pitch, timing and timbre, can be played for each of these input stimuli. A performance track 48*c* provides the information required to map each one of these input stimuli to a particular note or set of notes.

VI TREE

Figure 11B:
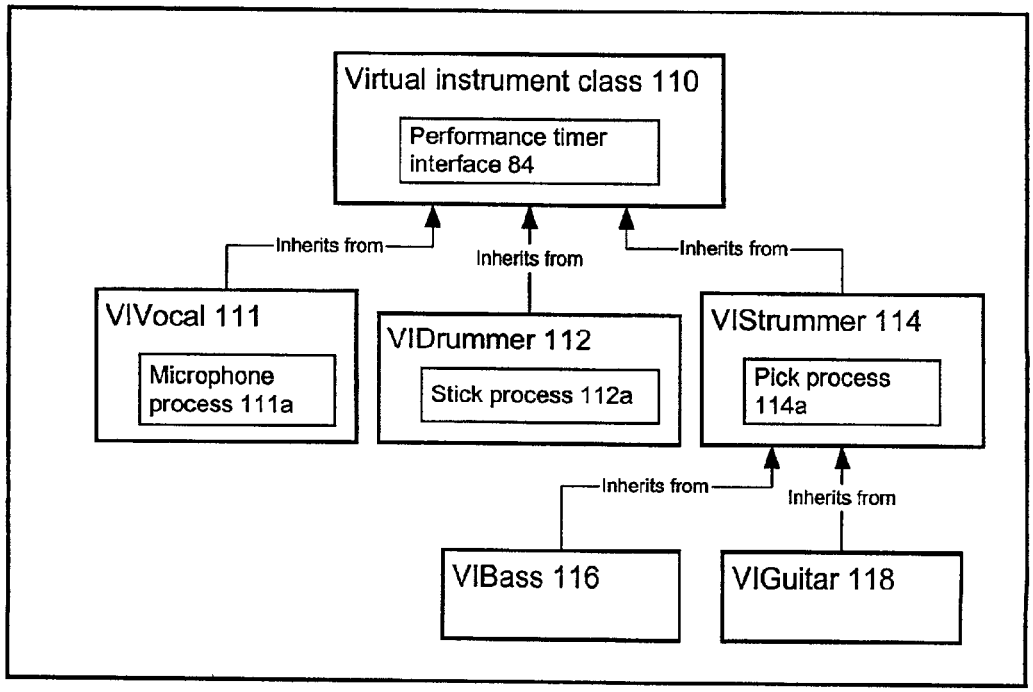
FIG. 11B is a diagram of virtual instrument inheritance.

Referring now to FIG. 11B, virtual instrument object 80 supports object inheritance. General characteristics of a virtual instrument, as expressed in the class 110 for virtual instrument object 80, can be inherited by subclasses that refine or customize these characteristics to their needs, as well as adding characteristics that do not apply to other subclasses of virtual instrument. For example, a VIVocal class 111 can include a microphone interface process 111*a*, while a VIDrummer object 112 includes a stick interface process 112*a*, and a VIStrummer object 114 includes a pick interface process 114. Each of these interface processes 110*a*, 112*a*, and 114*a* is unique to its class.

Subclasses of virtual instrument class 110 can have their own subclasses. For example, VIBass 116 and VIGuitar 118 each inherit from the VIStrummer class.

CUE DISPLAY

Referring now to FIG. 12A, cue display 82 prompts user 16 for input stimuli during a live performance. Cue display 82 renders the prompts in a user area 102 according to timing indicia in cue track 48*c*. These timing indicia vary in form depending on the type of virtual instrument input device 28 and virtual instrument being played. If virtual instrument input device 28 is a string input device 28 or a percussion input device 28, for instance, timing indicia are rendered as spikes 122. Each spike 122 graphically displays the point in time at which user 16 is to provide an input stimulus to the virtual instrument input device 28. The time is visually represented by the position of the spike 122 within a cueing region, along an axis 102*c*. This cue track 48*c* is the subject of U.S. Pat. No. 6,175,070 B1, entitled "System and Method for Variable Music Annotation", filed Feb. 17, 2000, issued Jan. 16, 2001, and incorporated herein by reference.

In addition to or instead of spikes 122, which only show the point in time at which the user 16 is to provide an input stimulus, cue display 82 can display information concerning the pitch of the notes being played, in the form of a staff (not shown) or note-based musical annotation, as provided by score track 48*d*. For instance, cue display 82 can render chord notation 102*e*, or (shown in FIG. 12B) tablatures 102*f* or 102*g*.

Cue display 82 can render spikes 122 as double spikes 122*a* on both of the sides of cueing region 102*b* that are aligned with time axis 102*c*. Alternatively, cue display 82 can render spikes 122 as single spikes 122*b* on one side of cueing region 102*b*.

Another alternative is two groups of single spikes 122*b*, on opposing sides of cueing region 102*b*. In this case, a first group of single spikes 122*b* provides cues, while the other group of single spikes 122*b* illustrates the timing of the actual input stimuli provided by user 16 during the live performance. Thus, the relative positions of the cuing spikes 122*b* and the stimuli spikes 122*b* provides graphic feedback regarding the accuracy of the user input, relative to the timing of the cues.

Referring now to FIG. 12B, spikes 122 are in a fixed position on cueing region 102*b* while a sweeper 102*h* repeatedly sweeps from left to right across the cueing region 102*b*. Alternatively, referring now to FIG. 12A, cueing region 102*b* and its contents can scroll to the left. In this latter scheme, the timing of each prompt is indicated by the corresponding spike 122 passing under a fixed timing indicator 102*i*.

For a live performance of a vocal part, cue display 82 can prompt the user 16 with lyrics. For a vocal part, the timing indicia provided by cue track 48*c* includes such lyrics, together with timing information indicating the specific point in time that each word or phrase is to be sung. Cue display 82 can sequentially render each word or phrase as highlighted lyrics 102*k* at the specific point in time that each word is to be sung, in coordination with sweeper 102*h* or timing indicator 102*i*.

Cue display 82 renders a name 102*a* in cueing region 102*b*. Name 102*a* typically contains text describing the part, corresponding to information provided in information chunk 44 (shown in FIG. 3B).

GLOBAL ACCOMPANIMENT

A live performance requires at least one track of musical instructions from the global accompaniment. Even if all parts are interactive, i.e. not audibly accompanied, a performance needs a master timing control.

Figure 13A:
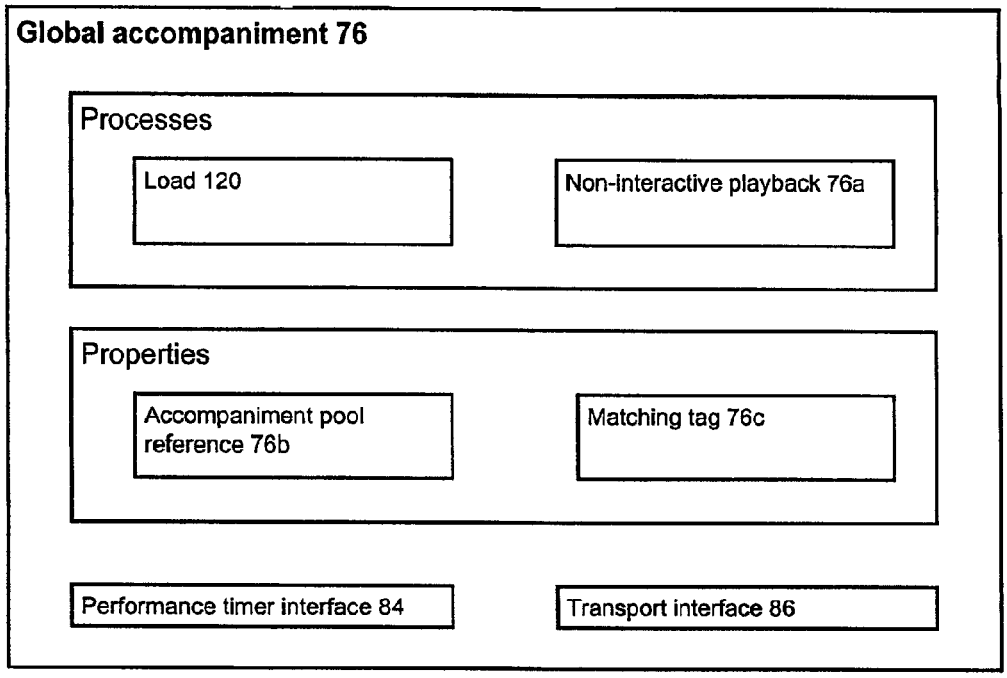
FIG. 13A is a block diagram of a global accompaniment.

Referring now to FIG. 13A, global accompaniment object 76 includes processes such as a accompaniment load process 120 and a non-interactive playback process 76*a*. Global accompaniment object 76 also includes properties such as accompaniment pool reference 76*b*, which locates the accompaniment pool 38 in data file 14 via performance pool object 78, and a matching tag 76*c*, which specifies sound fonts 39, similar to the matching tag 80*f* of virtual instrument object 80. However, the matching tag 80*f* of virtual instrument object 80 specifies compatible input devices 28, while matching tag 76*c* does not. (Global accompaniment object 76 does not require information on input devices 28, since global accompaniment object 76 plays non-interactive parts.)

Non-interactive playback process 76*a* renders the audio content of tracks chunk 38*a* and provides a master timing pulse for a live performance.

Global accompaniment object 76 implements a performance timer interface 84 and a transport interface 86, described with reference to FIG. 14A and FIG. 14B, respectively.

Figure 13B:
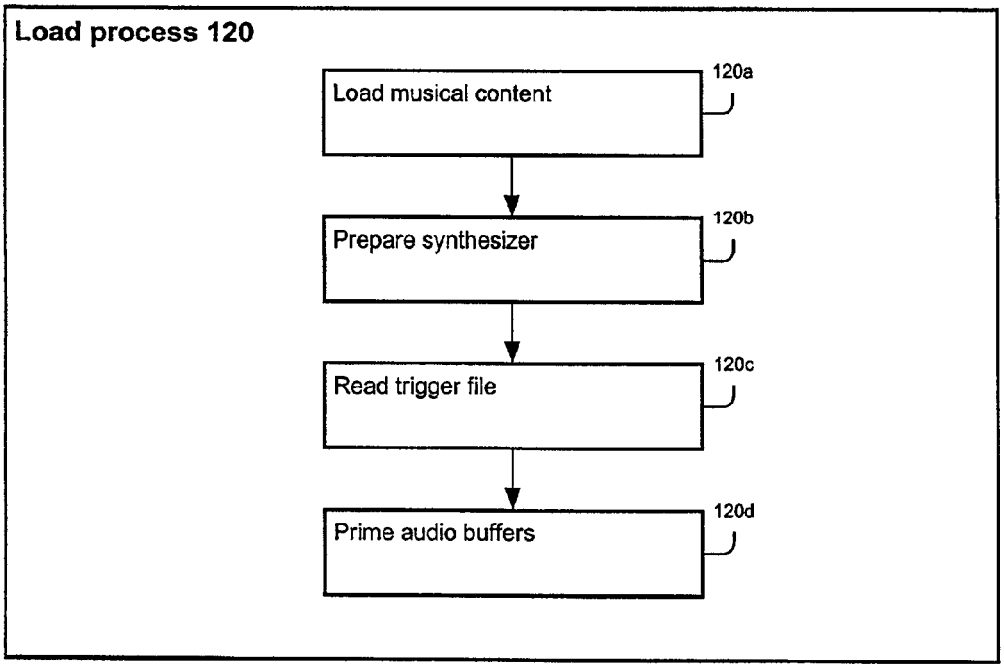
FIG. 13B is a flowchart of a global accompaniment load process.

Referring now to FIG. 13B, accompaniment load process 120 loads musical content from tracks chunk 38*a* (process 120*a*). Next, accompaniment load process 120 interacts with software synthesizer 66*a* to prepare it with sound fonts 39 (process 120*b*). Next, accompaniment load process 120 reads at least the first portion of DA trigger chunk 38*c* (process 120*c*). Accompaniment load process 120 then primes audio buffers of audio output subsystem 27 with initial samples of MP3 files from DA chunk 38*d*, if any exist (process 120*d*). The priming is advance of the signal from user 16 to begin the live performance. Priming the buffers improves responsiveness when that signal does occur.

PERFORMANCE TIMER AND TRANSPORT INTERFACES

In general, synchronous playback of the multiple part of multipart data file 14 requires a coordinated notion of timing.

Figure 14A:
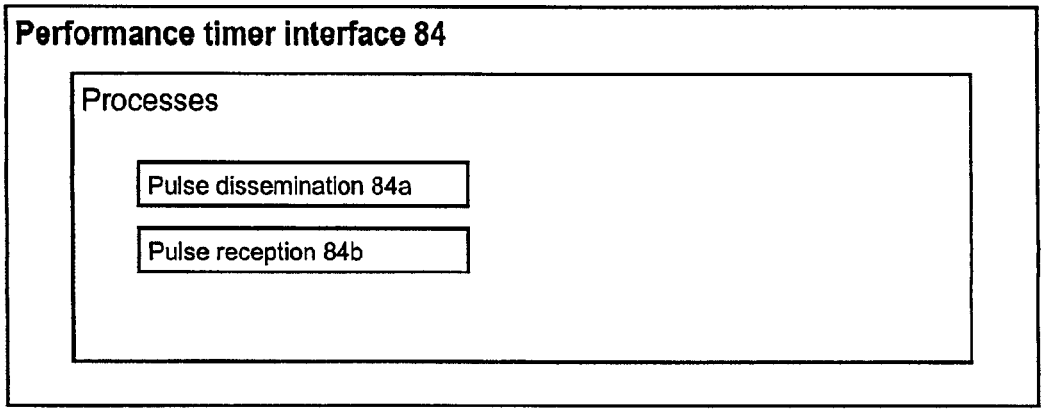
FIG. 14A is a diagram of a performance timer interface.

Referring now to FIG. 14A, a performance timer interface 84 allows the exchange of timing signals. In particular, performance timer interface 84 allows the dissemination of a clock pulse between objects that implement the performance timer interface 84.

Performance timer interface 84 includes a pulse dissemination process 84*a* and a pulse reception process 84*b*. Pulse reception process 84*b* lets a compliant object receive notice of timed events in synchronicity with a master timer. The global accompaniment object 76 acts as the master timer. It originates the clock pulse, based on timing information in the tracks chunk 38*a*, and uses the pulse dissemination process 84*a* to signal other objects that use the master timing signal, including performance object 72 and virtual instrument object 80.

Events that are timed and disseminated by the pulse dissemination process 84*a* include both the pulse and musical events, such as starts and stops of a live performance, boundaries of musical measures, and beats.

Figure 14B:
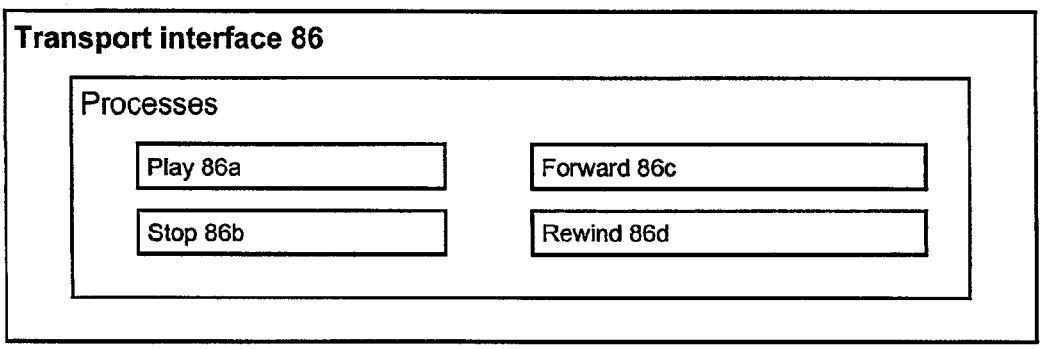
FIG. 14B is a diagram of a transport interface.

Referring now to FIG. 14B, a transport interface 86 describes processes for controlling the rate of playback of multipart data file 14. Transport interface 86 includes processes for play 86*a*, stop 86*b*, forward 86*c*, and rewind 86*d*. Transport interface 86 allows objects to coordinate synchronous playback of parts. In particular, performance object 72 and global accompaniment object 76 can control the rate of synchronous playback by virtual instrument object 80.

PERFORMANCE POOL

Figure 14C:
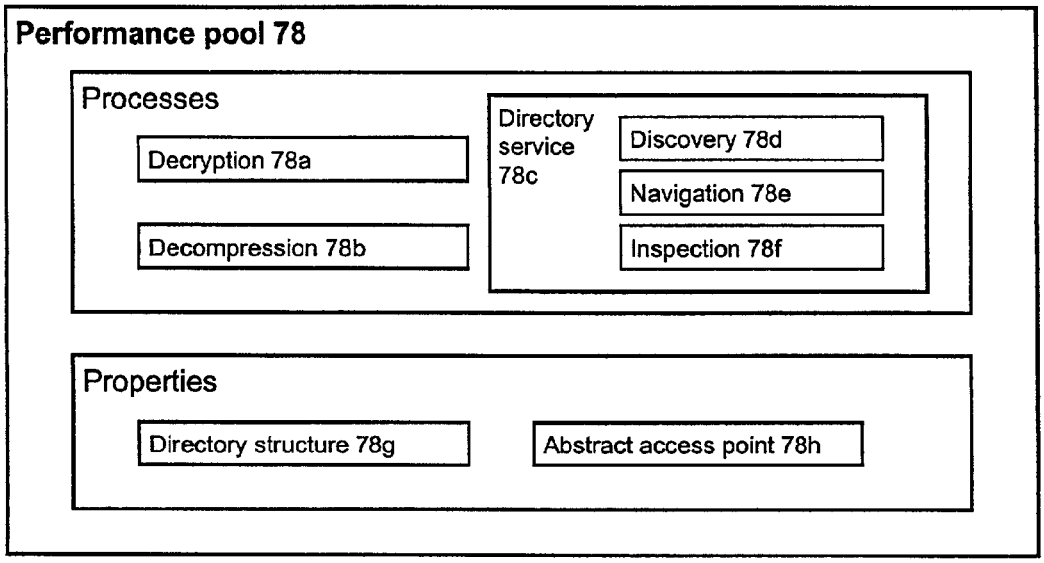
FIG. 14C is a diagram of a performance pool interface.

Referring now to FIG. 14C, performance pool object 78 includes processes such as decryption 78*a*, decompression 78*b*, and directory services 78*c*. Directory services 78*c* includes a discovery process 78*d*, a navigation process 78*e*, and an inspection process 78*f*. Performance pool object 78 also includes properties such as a directory structure 78*g* and an abstract access point 78*h*.

Performance pool object 78 provides directory services 78*c* into data file 14. In other words, performance pool mediates between objects of system logic 18 and the data file 14 in storage 12*b* or on server 30. Performance pool object 78 provides an abstract access point 78*h* to data, thus shielding virtual instrument objects 80, for example, from having to inspect the file structure of data file 14, or to know the location of data file 14. Performance pool object 78 can provide a different abstract access point 78*h* to different client objects.

In general, directory services 78*c* are processes that are exposed for other objects to use. Discovery process 78*d* discovers recursive data structures 78*g* such as chunks 50. Navigation process 78*e* allows objects to navigate between such data structures 78*g*. Inspection process 78*f* allows objects to view data structures 78*g* and access their contents.

Decryption 78*a* and decompression 78*b* translate storage formats of data file 14 into formats available for use in system logic 18. In general, performance pool object 78 shields other objects from information about encryption, the delivery mechanism of data file 14, the location of data file 14, and the internal file structure of data file 14.

ALTERNATE MIDI MAPPINGS

The MIDI protocol defines a time-encoded stream that can deliver note event data, along with other features such as a control stream. The note data assumes integer values from a range between 0 and 127 inclusive. Traditionally, each note in this range represents a distinct musical note in the Western musical scale, approximately encompassing the range of a traditional piano keyboard and most musical performances. According to this custom, the values of data in the note event stream represent notes for rendering by a synthesizer 66*a*. Also according to this custom, note event value 1 is a higher pitch than note event value 0, value 2 is higher than 1, and so forth throughout the range. A further custom is that non-note information, such as lyrics or control information, can be passed via MIDI in the control stream.

The architecture of DA trigger chunk 38*c* uses MIDI more generally, as a time-coded communication protocol. The values in the note event stream are semantically mapped to non-note meanings. In other words, the DA trigger architecture uses MIDI note event values to pass non-note data. In particular, the values in the note event stream are indexes to digital audio clips. The customary ordering of note event values (i.e., the notion that ascending note event values correspond to ascending pitch) is optional under this approach. For instance, the values in this alternative use of the MIDI note event stream can be chosen such that the index indicates the order in which the corresponding digital audio clip appears in the DA chunk 38*d* of file 14. Other orderings are also possible, or the note event values can be used without assigning any significance to their relative order.

Figure 15A:
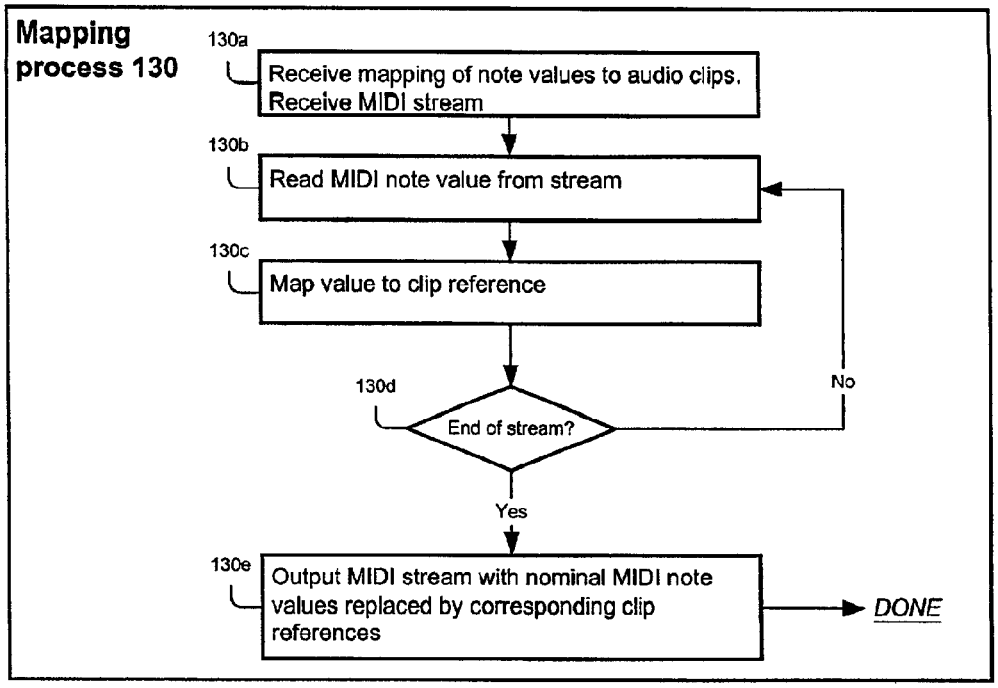
FIG. 15A is a flowchart of a mapping process.

Referring now to FIG. 15A, a mapping process 130 maps nominal MIDI note event values to non-note values, such as digital audio clips. For clarity, this description will use the term "MIDI note event value", since that is a conventional term for this portion of the MIDI stream. However, the term "note event value" in this context should be understood as not necessarily conveying musical note information. This description attaches the word "nominal" to emphasize that the MIDI note event value is referred to in name only. Indeed, one benefit of mapping process 130 is that it not restricted by the customary interpretations of MIDI note event values as musical notes.

Mapping process 130 receives a mapping of nominal note event values to audio clips, for use with a MIDI stream (process 130*a*). Each nominal note event values in the mapping corresponds to a different audio clip. Mapping process 130 reads a nominal note event value from the MIDI stream (process 130*b*). Mapping process 130 maps the value to non-note value, such as the index of an audio clip according to DA trigger chunk 38*c* (process 130*c*). Mapping process 130 returns to read subsequent values from stream until the end of the stream (process 130*d*). Mapping process 130 then outputs the MIDI stream with nominal MIDI note event values replaced by corresponding clip references (process 130*e*).

Figure 15B:
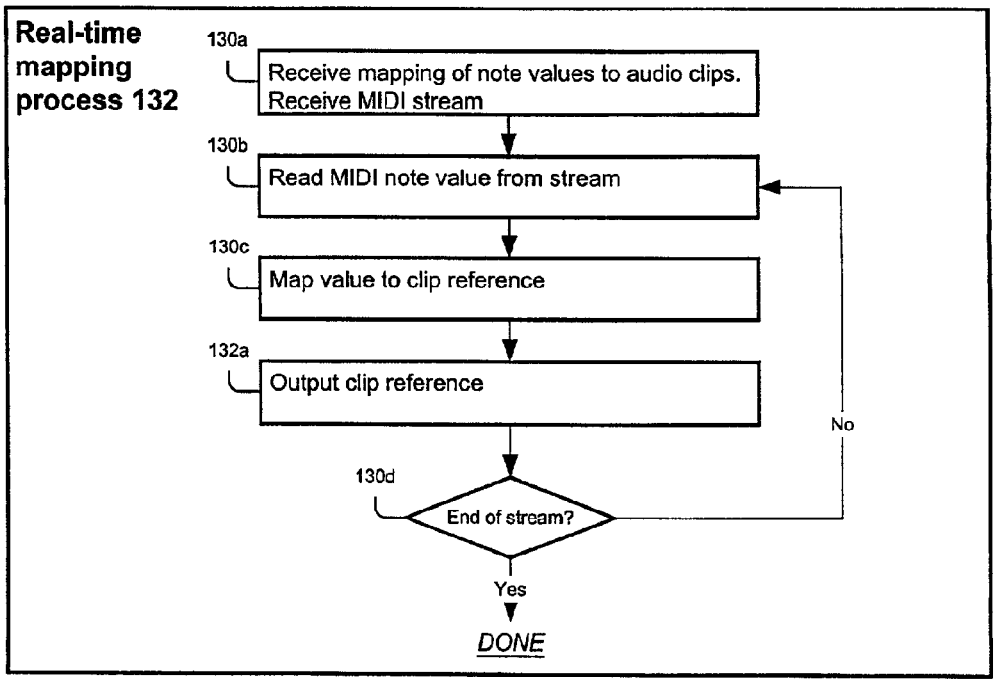
FIG. 15B is a flowchart of a real-time mapping process.

Referring now to FIG. 15B, a real-time mapping process 132 is similar to mapping process 130, above, except for the timing of the output. Real-time mapping process 132 omits the output stage (process 130*e*) of mapping process 130. After mapping the read value to an audio clip reference, and before repeating the next read, real-time mapping process 132 outputs the MIDI data with the current nominal MIDI note event value replaced by a corresponding current clip reference (process 132*a*).

Figure 16:
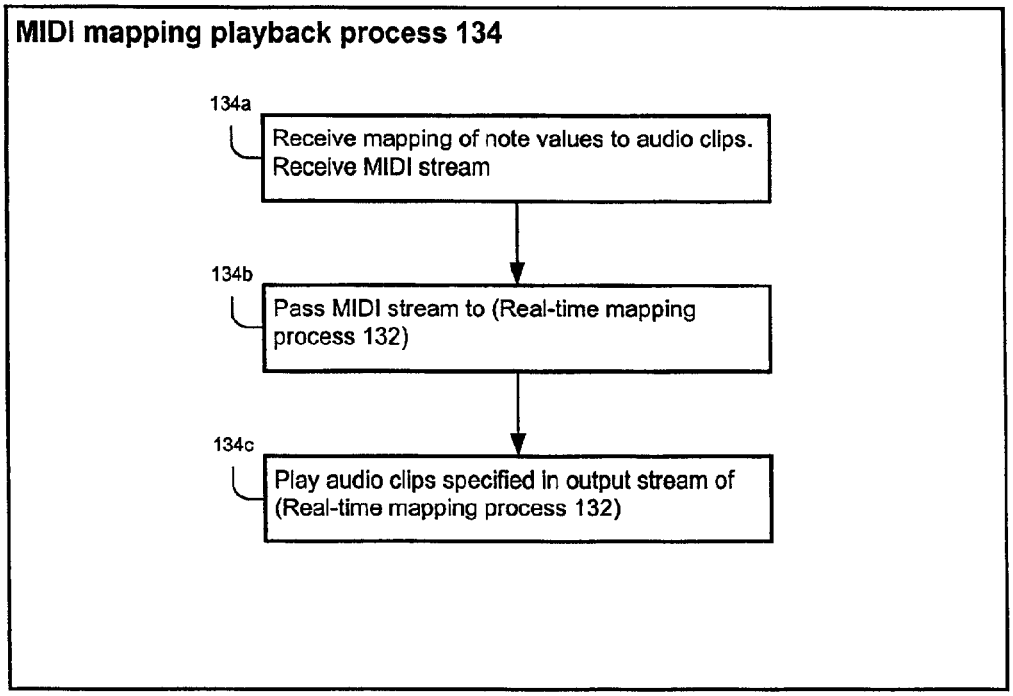
FIG. 16 is a flowchart of a MIDI mapping playback process.

Referring now to FIG. 16, a MIDI mapping playback process 134 incorporates a MIDI mapping process to play back audio clips reference in a stream of MIDI nominal note event values. MIDI mapping playback process 134 receives a MIDI stream and a mapping of note values to audio clips (process 134*a*). In the described embodiment, DA trigger chunk 38*c* provides a suitable mapping of nominal note event values to audio clips. MIDI mapping playback process 134 then uses real-time mapping process 132 on the MIDI stream, yielding a stream of references to audio clips (process 134*b*). MIDI mapping playback process 134 then renders the audio clips specified by the references (process 134*c*).

ALTERNATE EMBODIMENTS

While multipart data file 14 has been described as being transferred in a unitary fashion, this is for illustrative purposes only. Each multipart data file 14 is simply a collection of various components (e.g., interactive virtual instrument object 80 and global accompaniment object 76), each of which includes various subcomponents and tracks. Accordingly, in addition to the unitary fashion described above, these components and/or subcomponents can also be transferred individually or in various groups.

Moreover, in the described embodiment, data file 14 is a file on a storage medium 12*b* or shared storage 30*a*. However, the format of data file 14 applies to any digital medium. In alternate embodiments, the format of data file 14 organizes digital information in a stream, such as in a network communication flow, or digital information in main memory of client device 12 or a server 30.

Part encoding process 19 receives a standardized performance 15 with each part 15*c* designated interactive or non-interactive (process 19*a*). For example, a human administrator could provide such designations.

In this embodiment, operating system 18*a* is a Microsoft Windows operating system such as Windows 95, Windows NT 4.0, or other compatible operating systems.

Engine library 22 has been described has a DLL, but engine library 22 could be a software component according to another standard. Moreover, engine library 22 need not be separate from player 20 but could be integrated.

System logic 18 has been described as residing on client device 12, which executes system logic. Alternatively, system logic 18 could be distributed across multiple devices 12.

The header 32 has been described preceding the body 34 in data file 14. Other permutations of the orderings of the components of data file 14, either at a physical level or a logical level or both, are possible.

In the described embodiment, data file 14 contains one standardized performance 15. Alternatively, data file 14 can contain more than one standardized performance 15. As another alternative, data file 14 can contain fractional portions of a standardized performance 15. For example, a first file 14 could contain a song 15*a* while a second file 14 could contain supplemental or alternate parts 15*c*.

In the described embodiment, data file 14 has a format that uses chunks 50, including a body 34 that includes accompaniment pool 38 and VI pool 40, which in turn contain additional chunks 50. In alternate embodiments, data file 14 could have the same logical entities in a different format.

In the described embodiment, client device 12 is a personal computer. Other devices 12 are possible.

In the described embodiment, client device 12 includes storage 12*b*. Alternatively, storage 12*b* could be remote relative to client device 12.

Visual display device 26 could be a projector or other display.

In the described embodiment, to play a part, the user chooses the part, then the system automatically selects the sound fonts and an input device. In an alternate embodiment, the user can choose among types of sounds for the part.

In the described embodiment, synthesizer control data is MIDI nominal note event values which can adopt any of 128 distinct integer values in the range 0 to 127. In alternate embodiments, the synthesizer control data could be non-MIDI data. In other alternate embodiments, the synthesizer control data could be MIDI values other nominal note event values, or could adopt values from other ranges. In general, the synthesizer control data could be capable of adopting more (or less) than 128 distinct values.

In the described embodiment, digital audio clips are always played from the beginning. In alternate embodiments, system 10 could have random-access playback of digital audio clips.

In the described embodiment, mapping process 130 and real-time mapping process 132 map nominal note event values to audio clips. However, in general, mapping process 130 and real-time mapping process 132 translate nominal note event values to any non-note data, when provided with an appropriate map. In other words, mapping process 130 and real-time mapping process 132 each enable MIDI to be used as a general-purpose time-coded communication protocol. The map replaces the traditional musical meanings of MIDI nominal note event values with non-note meanings.

In the described embodiment, MIDI mapping playback process 134 uses real-time mapping process 132 on the MIDI stream. In alternate embodiments, MIDI mapping playback process 134 could use mapping process 130 instead of real-time mapping process 132.

The described embodiment makes use of objects in the architecture of system logic 18. However, in alternate embodiments, the data and processes of the described objects could be included in code or logic that does not use objects per se but that performs comparable processing of comparable data.

A number of embodiments of the invention have been described. Nevertheless, it will be understood that various modifications can be made without departing from the spirit and scope of the invention. Accordingly, other embodiments are within the scope of the following claims.

What is claimed is:

1. A computer-readable medium having a data structure encoding an audio-performance for interactive playback stored thereon, the data structure comprising:

a virtual instrument pool that encodes an interactive part of the audio performance, wherein audio content of the interactive part is encoded at least in a sequence of synthesizer control data, each datum in the synthesizer control data specifying a digital sample of the audio content to be played back; and a global accompaniment pool that encodes non-interactive portions of the audio performance, including timing information to synchronize the playback of the non-interactive portions of the audio performance, wherein the encoded interactive part of the audio performance includes data distinguishing it from the non-interactive portions of the audio performance and identifying it is an interactive part of the audio performance.

2. The medium of claim 1, wherein the synthesizer control data is MIDI data.

3. The medium of claim 1, wherein the digital sample is an MP3 clip.

4. The medium of claim 1, wherein the global accompaniment pool includes a collection of sound fonts, each such sound font providing parameters for synthesizing the playback of an interactive part.

5. A computer-readable medium having a data structure encoding an audio performance for interactive playback stored thereon, the data structure comprising:

a global accompaniment pool that encodes a non-interactive part of the audio performance, wherein a portion of the non-interactive part is encoded as synthesizer control data, and another portion of the non-interactive part is encoded as digital samples of the audio performance; and a virtual instrument pool that encodes an interactive part of the audio performance, the interactive part having audio content encoded at least in synthesizer control data, each datum in the synthesizer control data specifying one or more musical notes to be synthesized or specifying a digital sample of the audio content to be played back, wherein the encoded interactive part of the audio performance includes data distinguishing it from the non-interactive portions of the audio performance and identifying it is an interactive part of the audio performance.

6. The medium of claim 5, wherein the synthesizer control data is MIDI data.

7. The medium of claim 5, wherein the digital samples are MP3 clips.

8. The medium of claim 5, wherein the virtual instrument pool includes cue data that specifies prompts coordinated with the audio content the interactive part.

9. Code stored on a computer readable medium, said code for running on a computer in an entertainment system that includes an audio output subsystem, an input device, and a memory storing a musical performance data structure having an interactive portion of a musical performance and an accompanying, non-interactive portion of the musical performance, said code comprising:

a virtual manager object which causes the computer to read the musical performance data structure stored in the memory and generate a virtual object representing a virtual instrument identified in said performance data structure, wherein said virtual manager object causes said computer to map each user input signal of a sequence of user input signals from the input device to a corresponding different one or more notes encoded in the interactive portion of the musical performance and thereby cause the corresponding different one or more notes to play through the audio output subsystem; and a global accompaniment object which causes the computer to play the accompanying non-interactive portion of the musical performance through the audio output system.

10. The code of claim 9 wherein the global accompaniment object also comprises logic which when executed on the computer causes said computer to provide a master timing signal for the virtual object.

11. The code of claim 9 wherein the entertainment system includes, a plurality of input devices one of which is the first-mentioned input device, wherein the stored musical performance data structure identifies a plurality of different virtual instruments each representing a different musical instrument, and wherein the virtual manager object causes the computer to generate a plurality of virtual objects, each of which represents a different corresponding one of the identified plurality of instruments, said plurality of virtual objects including the first mentioned virtual object, wherein each of said plurality of virtual objects causes said computer to map user input signal of a sequence of user input signals from a corresponding one of the input devices to a corresponding one or more notes encoded in a corresponding part of the interactive portion of the musical performance and thereby cause those notes to play through the audio output subsystem.

12. The code of claim 10 wherein the entertainment system includes a video display subsystem and the stored musical performance data structure includes a stored sequence of timing cues associated with the interactive portion of the musical performance and wherein said virtual object also comprises logic which causes the computer to display a visual representation of the timing cues through the video display system to aid the user in playing the virtual instrument.

13. The code of claim 12 wherein the stored musical performance data structure includes a plurality of digital clips each representing a different part of the non-interactive portion of the musical performance and a sequence of trigger points, each of said trigger points presenting timing information and identifying which one of said digital clips is to be played at times identified in the timing information, wherein the global accompaniment object comprises logic which causes the entertainment system to play through the audio output subsystem the identified one of the plurality of digital clips at the appropriate time as identified by the stored sequence of trigger points.

14. The code of claim 13 wherein the audio output subsystem includes a synthesizer and the stored musical performance data structure includes sound fonts and wherein the accompaniment object further comprises logic that causes the computer to retrieve the sound fonts from the stored musical performance data structure and load them into the synthesizer to control the character of the audio output subsystem.

15. The medium of claim 1, wherein the data in the interactive part includes a cue track which specifies time intervals during which the user is prompted for input.

16. The medium of claim 1, wherein the data in the interactive part includes a score track that encodes musical notations for display during playback.

17. The medium of claim 1, wherein the data in the interactive part includes a video track which provides interactive visuals for displaying during playback.

18. The medium of claim 5, wherein the data in the interactive part includes a cue track which specifies time intervals during which the user is prompted for input.

19. The medium of claim 5, wherein the data in the interactive part includes a score track that encodes musical notations for display during playback.

20. The medium of claim 5, wherein the data in the interactive part includes a video track which provides interactive visuals for displaying during playback.

21. The code of claim 9, wherein the virtual manager object includes code which causes the computer to display a cue track in accordance with data stored in the musical performance data structure.

* * * * *